US007591396B2

(12) United States Patent
Tramontina et al.

(10) Patent No.: US 7,591,396 B2
(45) Date of Patent: Sep. 22, 2009

(54) RESTRICTOR AND DISPENSING SYSTEM

(75) Inventors: Paul Francis Tramontina, Alpharetta, GA (US); Richard Paul Lewis, Marietta, GA (US); Guy William Provenzano, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 583 days.

(21) Appl. No.: 11/420,085

(22) Filed: May 24, 2006

(65) Prior Publication Data

US 2006/0266759 A1 Nov. 30, 2006

Related U.S. Application Data

(63) Continuation-in-part of application No. 11/140,342, filed on May 27, 2005, now Pat. No. 7,428,978.

(51) Int. Cl.
*B65H 3/00* (2006.01)

(52) U.S. Cl. ..... 221/39; 221/37; 221/40; 221/151; 221/152; 221/213; 221/249; 221/259

(58) Field of Classification Search ..... 221/37, 221/213, 249, 214, 269, 254, 259, 210, 251, 221/270, 151, 152, 39, 46
See application file for complete search history.

(56) References Cited

U.S. PATENT DOCUMENTS

| | | | | |
|---|---|---|---|---|
| 1,511,812 | A | 10/1924 | Horwitt | |
| 1,603,714 | A | 10/1926 | Rappleye | |
| 2,247,800 | A | 7/1941 | Broeren et al. | |
| 2,588,152 | A * | 3/1952 | Newman | 221/37 |
| 3,243,078 | A | 3/1966 | Pherson | |
| 3,266,665 | A | 8/1966 | Eakens | |
| 3,301,746 | A | 1/1967 | Sanford et al. | |
| 3,306,491 | A * | 2/1967 | Eisner et al. | 221/41 |
| 3,322,617 | A | 5/1967 | Osborne | |
| 3,517,855 | A * | 6/1970 | Hillis | 221/259 |
| 3,650,882 | A | 3/1972 | Thomas | |
| 3,767,188 | A * | 10/1973 | Rosenberg et al. | 221/46 |
| 4,100,324 | A | 7/1978 | Anderson et al. | |
| 4,214,662 | A * | 7/1980 | Jonas | 206/555 |

(Continued)

FOREIGN PATENT DOCUMENTS

GB 917049 1/1963

*Primary Examiner*—Gene Crawford
*Assistant Examiner*—Timothy R Waggoner
(74) *Attorney, Agent, or Firm*—Sue C. Watson

(57) ABSTRACT

A restrictor and dispensing system for dispensing sheet material is provided. The restrictor includes a restrictor body positioned on a top sheet of a stack of sheet materials which are positioned in a dispenser. The restrictor assists in one at a time dispensing from a dispensing assembly. The dispensing assembly includes the dispenser, which has a housing including a container and a lid, and the housing is configured to hold and dispense sheet material. The dispenser also includes a sheet mover mounted to the housing. The sheet mover is configured to move over at least a portion of a sheet material away from additional sheet materials for dispensing. The restrictor cooperates with the housing and sheet mover to dispense one sheet material at a time. The restrictor may be provided with the dispenser, or separately. Alternatively, the restrictor may be provided in a cartridge filled with a stack of sheet materials.

20 Claims, 16 Drawing Sheets

U.S. PATENT DOCUMENTS 4,436,780 A 3/1984 Hotchkiss et al.
4,659,609 A 4/1987 Lamers et al.
4,737,393 A 4/1988 Linkous
5,048,589 A 9/1991 Cook et al.
5,284,703 A 2/1994 Everhart et al.
5,399,412 A 3/1995 Sudall et al.
5,494,554 A 2/1996 Edwards et al.
5,540,354 A 7/1996 Annand
5,607,551 A 3/1997 Farrington, Jr. et al.
5,672,248 A 9/1997 Wendt et al.
5,674,590 A 10/1997 Anderson et al.
5,687,876 A * 11/1997 Lucas, Jr. ..... 221/259
5,716,691 A 2/1998 Chan
5,772,845 A 6/1998 Farrington, Jr. et al.
5,776,306 A 7/1998 Hepford
5,904,971 A 5/1999 Anderson et al.
6,077,590 A 6/2000 Archer et al.
6,096,152 A 8/2000 Anderson et al.
6,248,212 B1 6/2001 Anderson et al.
6,273,996 B1 8/2001 Hollenberg et al.
6,533,145 B2 3/2003 Lewis et al.

* cited by examiner

RESTRICTOR AND DISPENSING SYSTEM

CROSS REFERENCE TO RELATED APPLICATIONS

This application is a continuation-in-part of U.S. Ser. No. 11/140,342 entitled "Sheet Material Dispenser" to Lewis et al., filed May 27, 2005, now U.S. Pat. No. 7,428,978 which is hereby incorporated by reference herein for all purposes.

BACKGROUND

Sheet materials, such as, but not by way of limitation, wipers stacked in a generally aligned configuration, are used for certain "clean" applications such as surgical rooms, electronic manufacturing, automotive painting and finishing, aerospace applications, and the like. Critical applications, such as procedures in clean rooms where silicone wafers are prepared to produce materials and/or apparatus such as integrated circuit devices, computer hard drives and the like make the use of wound sheet materials or interfolded sheet materials undesirable to use. Wound and/or interfolded sheet materials can result in linting, that is, shedding of small particles which can ultimately contaminate delicate silicone products. Wipers or sheet material for these clean applications must be "lint free" and are generally produced as individual sheets with their edges sealed normally by thermal or laser means. These wipers are usually sold in a stack of wipers which are not interfolded, and which are either dry or premoistened, generally, but not by way of limitation, with an isopropyl alcohol (IPA). Moistening may cause one or more wipers in the stack to cling together, making the separation of one wiper from the stack by an individual wearing gloves very difficult. However, it is desirable to dispense one wipe or sheet at a time, particularly in a clean room setting.

To address this problem, wipers have been wadded or otherwise packaged as a plurality of individual wipers packaged in pouches or pails. Pouches generally have a tabbed opening which is sealed with a resealable adhesive flap. Such adhesives often lose their ability to seal once they are wetted with an IPA or other liquid, and the wipers dry out. Pails employ a lid that can be difficult to remove and/or which often is not adequately sealed after use, allowing the alcohol to evaporate and the wipers to again dry out. Further, use of a pouch or pail requires a user to hold the pouch or pail with one hand and withdraw the wiper with the other hand.

It would be desirable for ergonomic, production efficiency and cost-in-use to provide a dispenser which would dispense one premoistened or dry wiper at a time. Such a dispenser may desirably more easily dispense one wiper to a user.

Further, since the edges of the sheets or wipers are heat or laser sealed to reduce or eliminate lint, the edges may be somewhat irregular. When one wiper is moved or slid across the others in the stack, the irregularities on the edge may cause the wiper to snag or catch another wiper and drag it partially or completely out during dispensing of the stacked wipers, resulting in waste.

To reduce or eliminate such waste, it would be desirable to provide a restrictor, such as a weighted plate, which is provided on the top of such a stack. Such a restrictor is desirably configured to allow for easy dispensing of one wiper at a time, while providing weight to at least a portion of the stack to prevent excessive dispensing from a top sheet being withdrawn snagging or moving one or more sheets below it when the top sheet is being dispensed.

Such a dispensing system may use a restrictor with a dispenser. Alternatively, such a dispensing system may use a restrictor in conjunction with a cartridge holding the stack of sheet materials which is configured to be disposed in the dispenser.

DEFINITIONS

As used herein, the term "exit port" or "dispensing port" is the opening in a housing of a dispenser for the passage of sheet material out of the dispenser.

As used herein, the terms "sheet material", "sheet materials", "wiper" "wipes" and "wipers" are interchangeable, and mean a material that is thin in comparison to its length and breadth. Generally speaking, sheet materials should exhibit a relatively flat planar configuration and be flexible to permit folding, rolling, stacking, and the like. Exemplary sheet materials include, but are not limited to, woven natural and/or synthetic material, nonwoven natural and/or synthetic material, cellulosic materials, such as, for example, paper tissue, paper towels, and so forth, or other fibrous material(s), film, polymers, filamentary products, and so forth.

As used herein, the term "fasteners" means devices that fasten, join, connect, secure, hold, or clamp components together. Fasteners include, but are not limited to, screws, nuts and bolts, rivets, snap-fits, tacks, nails, loop fasteners, and interlocking male/female connectors, such as fishhook connectors, a fish hook connector includes a male portion with a protrusion on its circumference. Inserting the male portion into the female portion substantially permanently locks the two portions together.

As used herein, the term "hinge" refers to a jointed or flexible device that connects and permits pivoting or turning of a part to a stationary component. Hinges include, but are not limited to, metal pivotable connectors, such as those used to fasten a door to frame, integrally molded ball and socket type, circular openings in components joined with a hinge pin and living hinges. Living hinges may be constructed from plastic and formed integrally between two members. A living hinge permits pivotable movement of one member in relation to another integrally connected member.

As used herein, the term "couple" includes, but is not limited to, joining, connecting, fastening, linking, or associating two things integrally or interstitially together.

As used herein, the terms "configure", "configured" and/or "configuration" means to design, arrange, set up, or shape with a view to specific applications or uses. For example: a military vehicle that was configured for rough terrain; configured the computer by setting the system's parameters.

As used herein, the term "sheet mover" refers to a portion of the pivotal leg which is used to move one or a few sheet materials away from a stack or plurality of sheet materials. Specifically, the embodiments shown herein include a toe of the pivotal let having a pick which has at least one tooth thereon. In addition, the embodiments shown herein include a portion of the toe which ruffles or bunches one or a few sheet materials away from a stack or plurality of sheet material. These embodiments are intended to be non-limiting, and other embodiments which create the movement of sheet material, either by snagging or grabbing the sheet material, or, alternatively, by ruffling or bunching the sheet material may be used.

As used herein, the term "pick" refers to a sharp or semi-sharp, generally pointed instrument, in this instance, the pick, and desirably, one or more teeth of the pick, which is used to pierce, make a small hole in, snag without piercing, grab or drag by means of friction a sheet material.

As used herein, the term "pusher" refers to an instrument, in this instance, at least a portion of the pivotal leg, and desirably the toe of the pivotal leg, which acts to ruffle, wrinkle or bunch a portion of one or a few sheet materials away from a stack or plurality of sheet materials.

As used herein, the terms "snag" or "grab" refers to contacting a thing, such as a portion of one or more sheet materials, and seizing and pulling the contacted portion of the sheet material.

As used herein, the terms "push", "bunch" "ruffle" and/or "wrinkle" refers to contacting and applying pressure to something, such as a portion of one or a few sheet materials, thereby creating a small furrow, ridge, hill or crease on a normally smooth surface for the purpose of moving the portion of the one or a few sheet materials.

As used herein, the term "about" includes plus or minus 10 percent of the numeral of a stated, implied or inherent amount at each end of a range.

As used herein, the term "substantially" refers to something which is done to a great extent or degree; a significant or great amount; for example, as used herein "substantially" as applied to "substantially" covered means that a thing is at least 90% covered.

As used herein, the term "alignment" refers to the spatial property possessed by an arrangement or position of things in a straight line or in parallel lines.

As used herein, the terms "orientation" or "position" used interchangeably herein refer to the spatial property of a place where or way in which something is situated; for example, "the position of the hands on the clock."

These terms may be defined with additional language in the remaining portions of the specification.

SUMMARY OF THE INVENTION

In response to the difficulties and problems discussed herein, a restrictor is provided. The restrictor is for use in a dispenser adapted to dispense a stack of sheet material, the stack having a top sheet positioned at an upper end of the stack of sheet material and a next sheet positioned under the top sheet. The restrictor comprises a body configured to be positioned on top of and across a back of a top sheet of a stack of sheet material disposed in a dispenser. When the dispenser is activated to remove sheet material, the body permits the top sheet to be dispensed from the dispenser. The body is configured to limit movement of the back of the top sheet and the next sheet. When the top sheet is moved away from the next sheet and dispensed, a front of the next sheet is positioned in a substantially flat position such that the next sheet becomes a new top sheet and it is positioned for dispensing when the dispenser is again activated.

In another aspect of the invention, a restrictor adapted for use in a dispenser which dispenses a stack of sheet material is provided. The restrictor comprises a body positioned to put pressure on a portion of an upper end of a stack of sheet material disposed in a dispenser. The body includes a front portion having narrow perimeter and an opening formed therein which provides a pick/push zone. The body also includes a back portion providing substantial weight relative to the front portion to a top sheet positioned at an upper end of a stack of sheet material thereby restricting its movement and the movement of a next sheet positioned under the top sheet and sheets positioned thereunder. The back portion has an opening which permits movement of the next sheet when a top sheet is dispensed from a dispenser.

In yet another aspect of the invention, a cartridge adapted for use in a dispenser for dispensing a stack of sheet materials is provided. The cartridge comprises a housing having an inner surface which forms an internal compartment for holding a stack of sheet material. The housing has an opening along an upper edge. The cartridge includes a stack of sheet material disposed in the compartment. The stack of sheet material has a top sheet positioned on an upper end of the stack and a next sheet positioned underneath the top sheet. The cartridge also includes a restrictor positioned on at least a portion of the top sheet of the stack of sheet material. The restrictor is positioned to provide pressure on at least a portion of the top sheet to restrict movement of sheet material in the housing. When the cartridge is positioned in a dispenser and when the dispenser is activated to remove sheet material, the restrictor acts to permit the top sheet to be dispensed from the dispenser. The restrictor is configured to limit movement of the top sheet and the next sheet to permit the top sheet only to be dispensed. When the top sheet is dispensed, the restrictor is configured to hold the next sheet in a position such that the next sheet becomes a new top sheet and the dispensing process is ready to be repeated.

In still another aspect of the invention, a system for dispensing sheet material is provided. The system comprises a dispenser including a housing. The housing comprises a container and a lid which cooperate to provide an inner surface formed to include an internal compartment configured to hold sheet material. The housing includes an exit port for withdrawal of sheet material. The housing further includes a sheet mover mounted to the housing. A portion of the sheet mover is configured to move over at least a portion of a sheet material positioned in the housing such that at least the portion of the sheet material is moved away from additional sheet materials positioned adjacent thereto by the sheet mover. When the portion is moved away it is positioned to be easily withdrawn through the exit port by a user. The system also includes a stack of sheet material disposed in the compartment of the housing. The stack of sheet material has a top sheet positioned on an upper end of the stack and a next sheet positioned underneath and next to the top sheet. The system further includes a restrictor positioned on at least a portion of the top sheet of the stack of sheet material. The restrictor is positioned to provide pressure on at least a portion of the top sheet to restrict movement of the sheet material in the housing. When the dispenser is activated to dispense sheet material via movement of the sheet mover, the restrictor acts to permit the top sheet to be dispensed from the dispenser. The restrictor is configured to limit movement of the top sheet and the next sheet to permit only the top sheet to be dispensed. When the top sheet is dispensed, the restrictor acts to hold the next sheet in a position such that the next sheet becomes a new top sheet and the dispensing process is ready to be repeated.

In still yet another aspect of the invention, a system for dispensing sheet material is provided. The system comprises a dispenser including a housing. The housing comprises a container and a lid which cooperate to provide an inner surface formed to include an internal compartment configured to hold sheet material. The housing includes an exit port for withdrawal of sheet material. The housing further includes a sheet mover mounted to the housing. A portion of the sheet mover is configured to move over at least a portion of a sheet material positioned in the housing such that at least the portion of the sheet material is moved away from additional sheet materials positioned adjacent thereto by the sheet mover. The portion moved away is positioned to be easily withdrawn through the exit port by a user. The system also includes a cartridge adapted for use in a dispenser for dispensing a stack of sheet materials. The cartridge comprises a housing having an inner surface which forms an internal compartment for holding a stack of sheet material. The housing also includes an opening formed along an upper edge thereof. The cartridge also includes a stack of sheet material disposed in the compartment. The stack of sheet material has a top sheet positioned on an upper end of the stack and a next sheet positioned underneath the top sheet. The cartridge further includes a restrictor positioned on at least a portion of the top sheet of the stack of sheet material. The restrictor is positioned to provide pressure on at least a portion of the top sheet to restrict movement of the sheet material in the housing. When the cartridge is positioned in a dispenser and when the dispenser is activated to dispense sheet material via the movement of the sheet mover, the restrictor acts to permit the top sheet to be dispensed from the dispenser. The restrictor is configured to limit movement of the top sheet and the next sheet to permit only dispensing of the top sheet. When the top sheet is dispensed, the restrictor is configured to hold the next sheet in a position such that the next sheet becomes a new top sheet and the dispensing process is ready to be repeated.

Other features and aspects of the present invention are discussed in greater detail below.

BRIEF DESCRIPTION OF THE DRAWINGS

The present invention will be more fully understood from the following detailed description, taken in conjunction with the accompanying drawings (not to scale), wherein like reference numerals refer to like parts, and in which.

DETAILED DESCRIPTION

Figure 1:
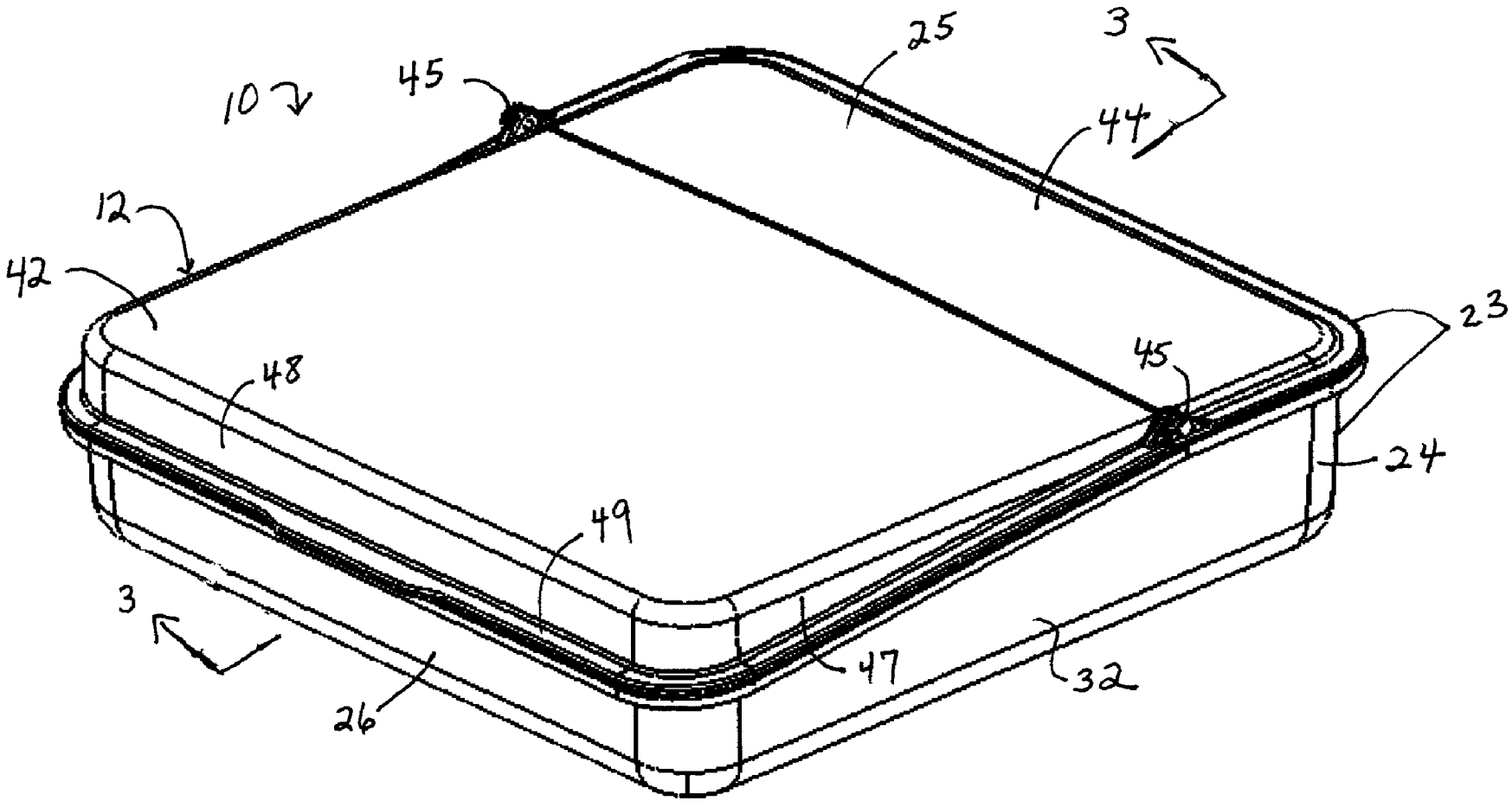
FIG. 1 is a perspective view of the system and dispenser of the present invention, showing a housing having a lid and a tray container.

Reference will now be made in detail to the presently preferred embodiments of the invention, one or more examples of which are illustrated in the drawings. Each example is provided by way of explanation of the invention and is not meant as a limitation of the invention. For example, features illustrated or described as part of one embodiment or figure can be used on another embodiment or figure to yield yet another embodiment. It is intended that the present invention include such modifications and variations.

The present invention provides an apparatus for dispensing stacks of sheet materials. Such sheet materials may include, but are not limited to, woven materials, nonwoven materials, synthetic materials, natural materials, foils, polymer films, any combination thereof, and so forth. Exemplary sheet materials for which the present invention is suitable include, but are not limited to, absorbent sheet materials such as towels, wipers, tissue, napkins, and so forth. The specific composition of the sheet materials dispensed can vary as desired. Exemplary sheet materials and methods of making the same include, but are not limited to, those described in U.S. Pat. Nos. 3,301,746; 3,322,617; 3,650,882; 4,100,324; 4,436,780; 4,659,609; 4,737,393; 5,048,589; 5,284,703; 5,399,412; 5,494,554; 5,607,551; 5,672,248; 5,674,590; 5,716,691; 5,772,845; 5,776,306; 5,904,971; 6,077,590; 6,248,212; 6,273,996; 6,096,152; and so forth. While woven and/or nonwoven sheet-like products are generally discussed with regard to the sheet material shown and/or described in embodiments herein, it will be understood that various other products could be substituted therefore.

Desirably, but not by way of limitation, the sheet materials for which the present invention is suitable are provided as a stack of sheet materials. Such sheet materials may be connected or un-connected. The sheet materials may be folded, interfolded, tabbed and/or festooned. Desirably, however, the sheet materials are provided as individual sheets in a stack of generally aligned sheet materials.

The present invention, as illustrated in FIGS. 1-22, comprises a system 10 which includes a dispenser 12 and sheet materials 14. The sheet materials 14 may be provided in a cartridge 16 or separately. If the sheet materials 14 are provided in a cartridge 16, it may include a cover 17 which may also include a removable seal or release sheet 18 which is positioned as a seal over an opening 19 therein (shown in FIGS. 10-13). A restrictor 20 is desirably provided as well (FIGS. 14-21). The restrictor 20 is desirably positioned on top of the sheet materials 14, which are desirably provided in a stack 22 of sheet materials, whether the sheet materials 14 are provided separately, or in the cartridge 16. Therefore, the restrictor 20 may be provided separately (FIGS. 14-16) or with the dispenser 12, or it may be provided on top of a stack 22 of sheet materials 14 contained in the cartridge 16 (FIGS. 17-21).

The sheet materials 14 may be premoistened with a liquid. Alternatively, the sheet materials 14 may be dry. Desirably, the stack 22 of sheet materials 14 are provided as single or individual sheet materials which are not connected to each other, and the stack 22 is desirably provided in a generally aligned and planar orientation.

Referring now to FIGS. 1-9, the system 10 includes the dispenser 12 which comprises a dispenser housing 23 having a tray container 24 and a lid 25. The tray container 24 includes a front wall 26 and a back wall 28 which are spaced-apart and intersect a lower end 30, as illustrated in FIGS. 1-5. A pair of spaced-apart side walls 32 intersect the lower end 30 and cooperate with the front and back walls 26, 28 to provide an inner surface 34 which provides an internal compartment 36 configured to hold sheet materials 14, desirably a stack 22 of sheet materials 14 or a cartridge 16 of sheet materials 14 in the tray container 24 and dispenser housing 23. The front wall 26, back wall 28 and side walls 32 may include a flange 38 which is provided along an upper edge 39 of the tray container 24. The flange 39, for example, but not by way of limitation, may extend at a generally perpendicular angle relative to the front and back walls 26, 28 and sidewalls 32. The tray container 24 may include a mechanism (not shown) which permits it to releasably coupled to the lid 25, which may also have a cooperative mechanism, which permits the lid 25 to be held in a closed position against the upper edge 39 and flange 38 of the tray container 24.

The lid 25 is desirably pivotably coupled to the tray container 24, and desirably provides sufficient closure to maintain premoistened sheet material 14 disposed therein in a premoistened state when such premoistened sheet material 14 is loaded in the dispenser 12 or when liquid is provided to the sheet material 14 disposed in the dispenser 12. The lid 25 may comprise one piece. Desirably, however, as illustrated herein, the lid 25 may include a first lid section 42 which is desirably, but not by way of limitation, pivotably coupled to a second lid section 44 via at least one hinge 45 to permit the internal compartment 36 and the sheet materials 14 therein to be accessed by a user. In addition, this design permits the first lid section 42 to function as an exit port 46. The first lid section 42 may include a pair of spaced-apart tapered side walls 47 and a front wall 48 which cooperate to provide the first lid section 42.

The first and second lid sections 42, 44 may also include a lip 49 which extends outwardly from a lower perimeter edge 50 of the lid 25. The lip 49 of the lid 25 desirably cooperates with the upper edge 39 and flange 38 to provide a releasable closure to the dispenser housing 23 and to reduce or prevent moisture contained in the dispenser housing 23 from evaporating.

A locking assembly 51 for a sheet mover is provided in the dispenser housing 23 (FIGS. 2-5 and 8). The second lid section 44 includes a rod holder 52 coupled to an inner surface 34 of the second lid section 44 which has a pair of spaced-apart side walls 53 extending downward from the second lid section 44, and opening positioned in each side wall 53. A push rod 54 is pivotably coupled at one end to the rod holder 52. The push rod 54 includes, at the one end, a transversely positioned pivot bar 56 having a pin 58 at each end thereof. The pins 58 extend through openings in the side walls 53 of the rod holder 52 to permit the pivot bar 56 to pivotably couple to the rod holder 52. The push rod 54 includes, at an opposite end thereof, a generally, though not by way of limitation, U-shaped yoke 60. The yoke 60 includes a pair of spaced-apart side arms 62, each of which includes a slot (not shown) therein. A shield 64 for a pivotal leg is positioned on the inner surface 34 of the first lid section 42, and the shield 64 includes a pair of spaced-apart side walls 66 which extend downward from the inner surface 34 at a generally perpendicular angle thereto, each of which has an elongated slot 68 formed therein. Coupled to the shield 64 and yoke 60 is a sheet mover or pivotal leg 70, which is one primary operative member of the dispenser 12 but it is not a part of the locking assembly 51.

The pivotal leg 70 is configured to be moved at least partially out of the shield 64 yet also received and releasably held in the shield 64 of the locking assembly, as shown in FIGS. 2-9. The pivotal leg 70 includes at one end a transversely positioned pivotal bar 72 (FIG. 2) having, at each end thereof, a pin 74. The pivotal leg 70 also includes at an opposite end thereof a toe 76. A body 77 of the pivotal leg 70 extends between the leg 70 and the toe 76. The toe 76 may include, but not by way of limitation, one or more roller(s) or wheel(s) 78 which are rotatably mounted via a pin 80 on either side of the toe 76 which couples the at least one wheel 78 to the toe 76 and to permit the wheel 78 to rotate on an axis 81 which is generally transverse to the orientation of the toe 76. The wheel(s) 78 desirably moves tangent to a top sheet 82 of the stack 18 of sheet materials 14 to permit smooth movement of the toe 76 as it contacts and rolls or moves over the top sheet 82. Alternatively, the toe 76 is provided without the at least one roller or wheel (not shown). The toe 76 is desirably formed to remove frictional resistance and to permit smooth contact and movement of the toe 76 over the sheet material 14 until the toe 76 reaches a point of desirably moving and/or lifting the sheet material 14.

Figure 14:
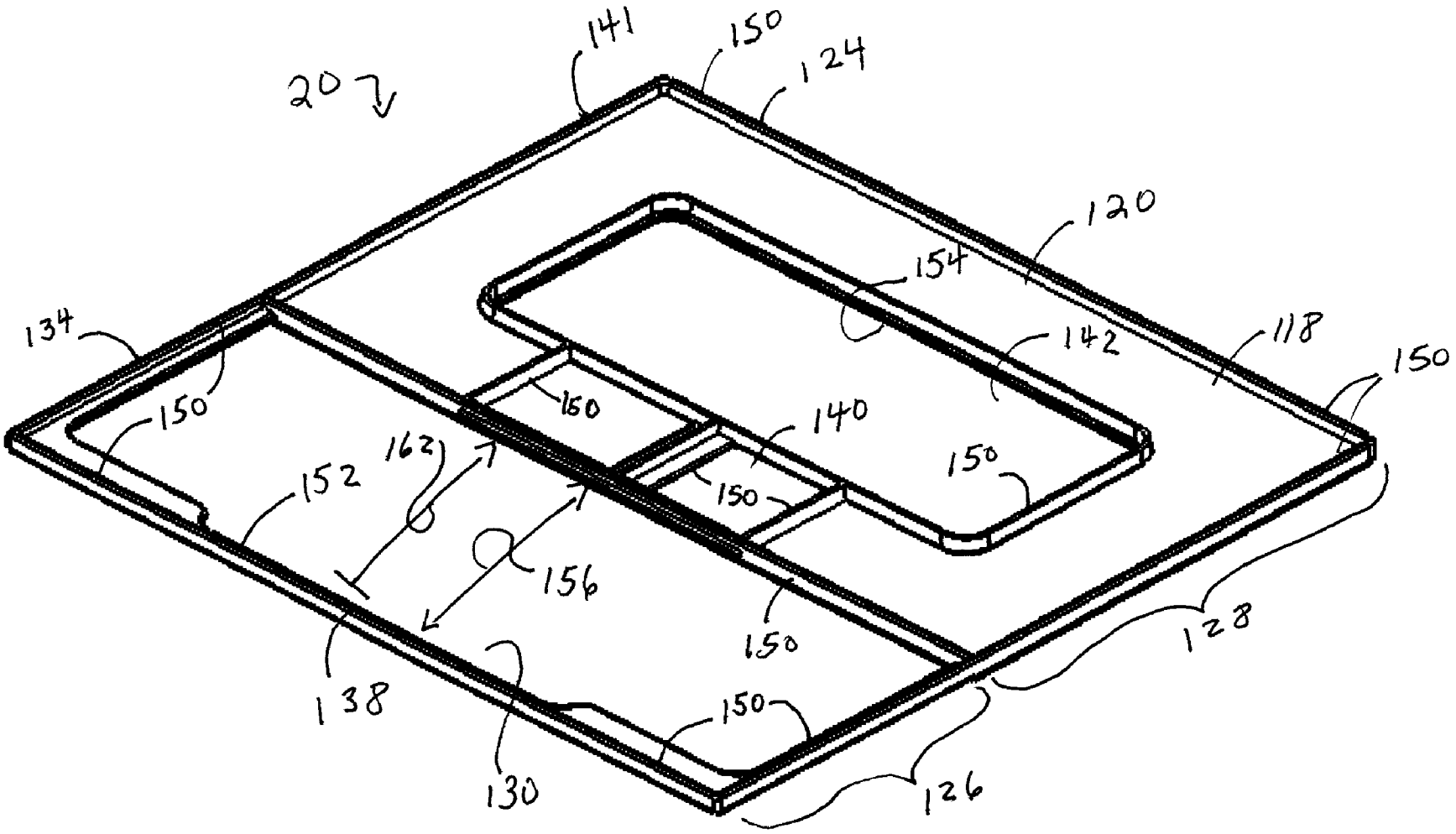
FIG. 14 is a perspective view of the restrictor of the present invention.
Figure 15:
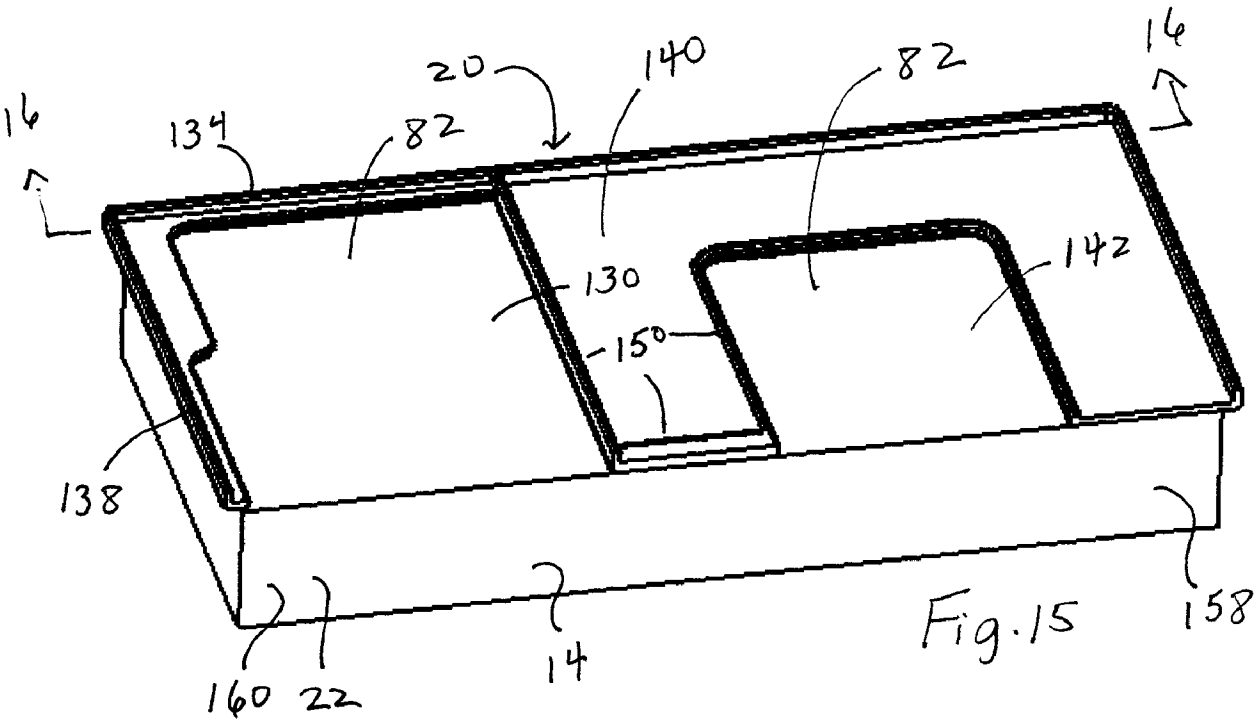
FIG. 15 is a perspective sectional view of the restrictor in a position on the top sheet of a stack of sheet material.
Figure 16:
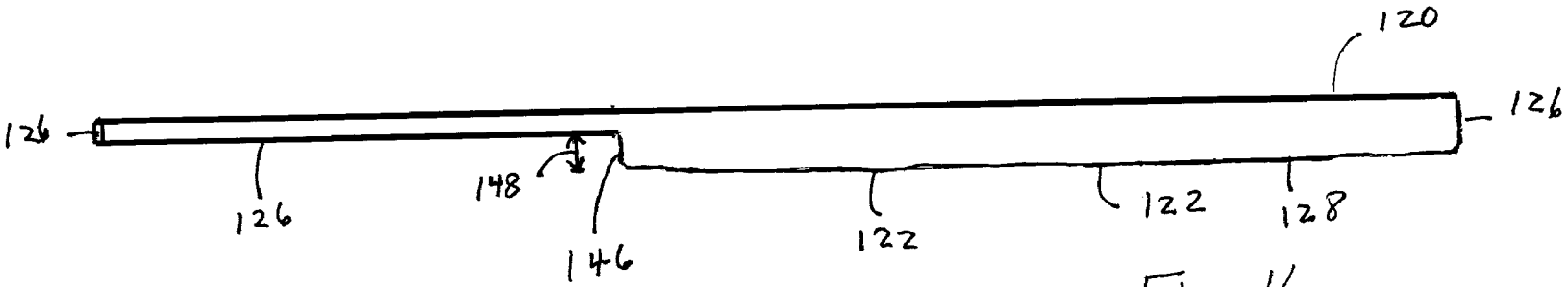
FIG. 16 is a sectional view of FIG. 15, taken along lines 16-16.
Figure 19:
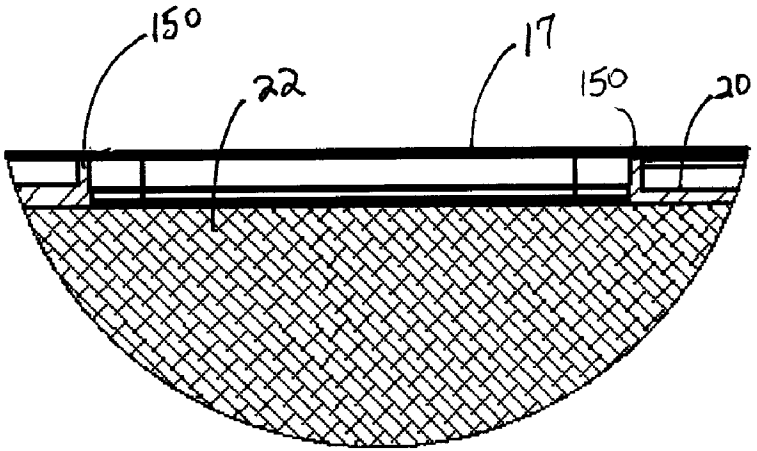
FIG. 19 is a partial sectional view of FIG. 18 taken along line 19.
Figure 17:
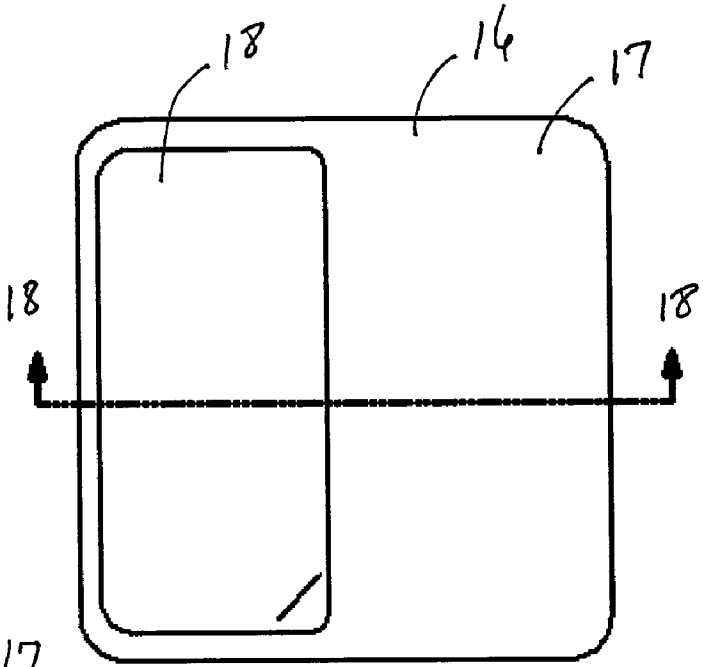
FIG. 17 is a top plan view of a cartridge having a restrictor and a stack of sheet material therein.
Figure 18:
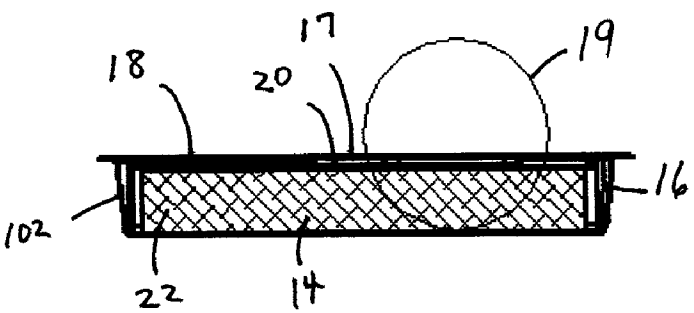
FIG. 18 is a sectional view of FIG. 17 taken along lines 18-18.
Figure 21:
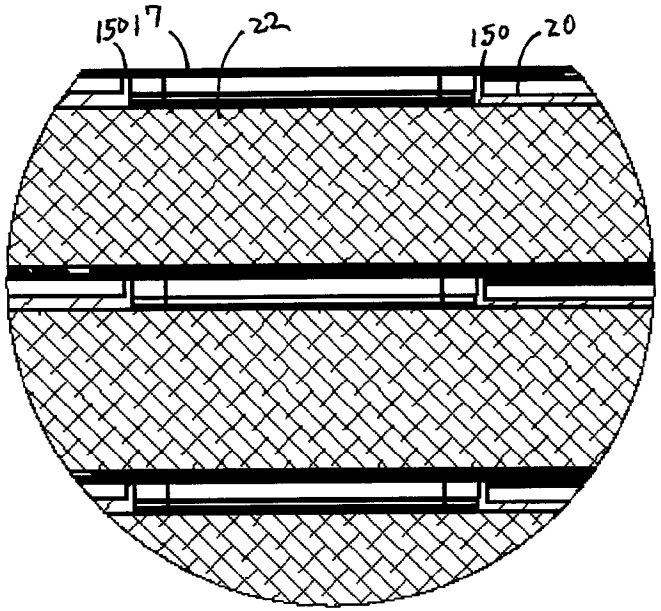
FIG. 21 is a partial sectional view of FIG. 20 taken along line 21.
Figure 20:
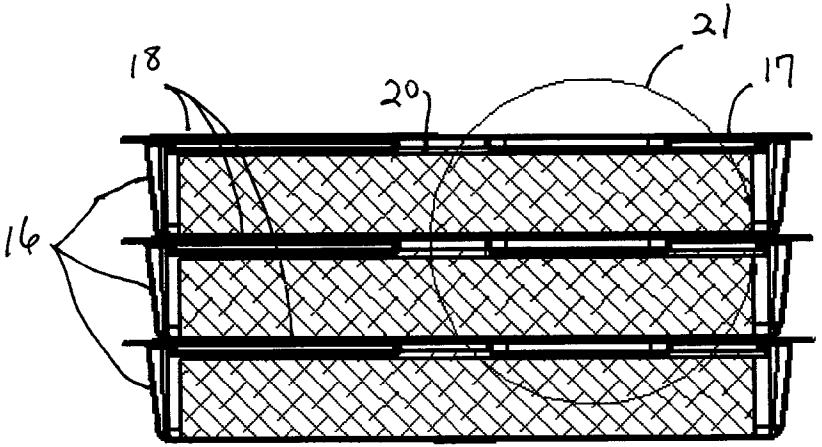
FIG. 20 is a sectional view similar to FIG. 18, but showing three cartridges having restrictors and sheet material disposed therein and covers on the upper surface; showing the support of weight of the cartridges received by a plurality or ribs on the restrictor positioned adjacent the cover.

A lower surface 84 of the toe 76 desirably includes at least one tooth or similar apparatus which acts as a pick 86 (illustrated best in FIGS. 6-9). As the toe 76 moves across an upper surface of the top sheet 82, the lower surface 84 of the toe 76 is slightly rotated due to the changing angle of the toe 76 as the first lid section 42 is lifted. This action causes the toe 76 to move across the top sheet 82 until it moves or rotates sufficiently such that the pick 86 comes into contact with the top sheet 82 of the stack 22 of sheet materials 14. The pick 86 moves against the top sheet 82 to desirably snag, grab and pick up a portion of the top sheet 82, when the first lid section 42 of the lid 25 is lifted, as will be described in greater detail below. Desirably, but not by way of limitation, the pick 86 is configured to snag or grab the top sheet 82 and may slightly pierce a very small portion of the upper surface 88 of the top sheet 82 without tearing the top sheet 82 or creating any significant aperture or opening therein. This action moves or lifts a portion 89 of the top sheet 82 upward and away from the stack 22 such that the portion 89 is puckered, bunched, ruffled, wrinkled, and/or moved upward in a direction 90, away from the stack 22. Desirably, as the pivotal leg 70 continues to move, the pick 86 becomes disengaged (FIG. 9) from the portion 89 such that the portion 89 remains in its bunched, ruffled, wrinkled and/or puckered position away from the stack 22, for easy removal by a user. Alternatively, the portion 89 may remain coupled to the pick 86 for removal by a user. A restrictor 20 may be used and placed on the top sheet 82 of the stack 22 of sheet materials 14, as shown in FIGS. 14-16. The restrictor 20 may greatly enhance the reliable movement or "pick" of each top sheet 82 when the pivotal leg 70 moves thereagainst, and will be described in greater detail below.

In another alternative, the top sheet 82 is pushed by the toe 76 of the pivotal leg 70 to cause at least the portion 89 of the top sheet 82 to lift up and/or to move away in the direction 90 from the remaining stack 22 of sheet material 14. The top sheet 82, however, is not snagged, grabbed or attached to the pick 86 or the toe 76 of the pivotal leg 70. Instead, the pick 86 and/or toe 76 may be modified to create friction against at least the portion 89 of the top sheet 82 without snagging or otherwise attaching itself to the top sheet 82. That is, the pick 86, toe 76 and/or any portion of the leg 70 may be formed to rub, bunch, push and/or move the portion 89 of the top sheet 82 upward in the direction 90 and/or away from the remainder of the stack 22. In this manner, the pick 86, if any, and/or the toe 76 may include a material, such as, for example only, rubber, plastic, metal, and so forth and/or be formed with frictional characteristics which would cause sufficient friction against the top sheet 82 to cause bunching, ruffling, gathering and/or movement of the top sheet 82 to provide the portion 89 in the described position. Therefore, the toe 76 may be provided without a pick (not shown). The toe may include one or more ridges, raised portions, and so forth, to provide friction against the top sheet 82 (not shown). In this way, the portion 89 of the top sheet 82 presents itself to be removed from the dispenser 12 by a user, who would likely, but not by way of limitation, grasp the portion 89 between the user's thumb and first finger to do so. In this alternative, the restrictor may also be utilized (not shown).

It will be understood that the top sheet 82 is the uppermost sheet in the stack 22 of sheet material 14. The top sheet 82 is situated closest to the exit port 46. A next sheet 92 is provided immediately below and against the top sheet 82. When the top sheet 82 is removed from the stack 22, the next sheet 92 (FIG. 8), underneath the top sheet 82, becomes the new top sheet. Therefore, the new sheet under the new top sheet 82 becomes the new next sheet 92. This process desirably continues until all sheet materials 14 are dispensed from the dispenser 12.

Figure 2:
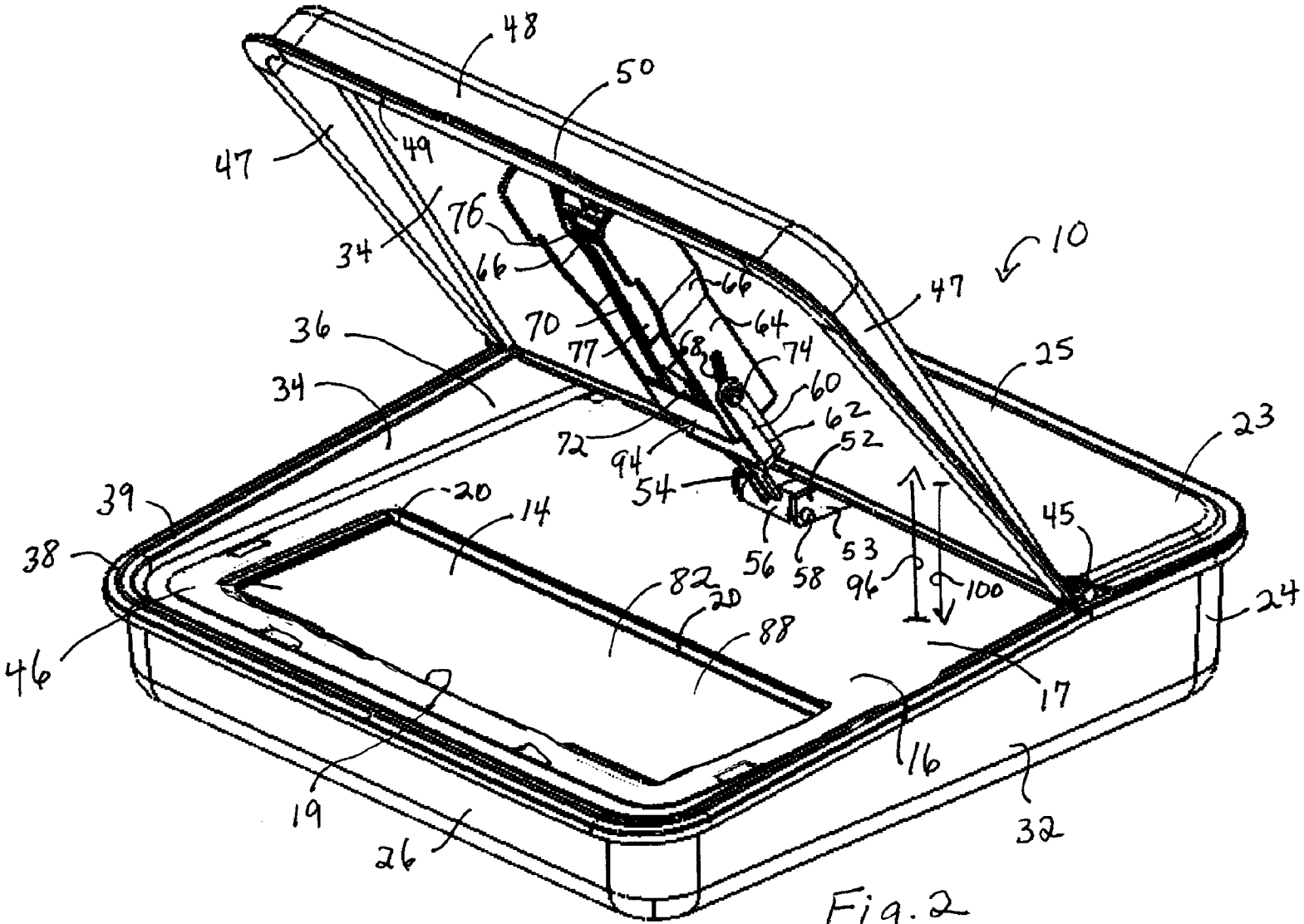
FIG. 2 is a perspective view of the system and dispenser of FIG. 1, but showing the lid lifted away from the tray container to show the cartridge having a restrictor therewith.

Turning back to the locking assembly 51, as illustrated in FIGS. 2-5 and 8, the ends of the pivotal bar 72 are desirably positioned through the elongated slot 68 of the shield 64 and the pins 74 on the ends 73 are desirably positioned through the slots (not shown) in the arms 62 of the yoke 60 of the push rod 54. The shield 64 may be formed integrally with or formed separately and coupled to the inner surface 34 of the first lid section 42 (FIG. 2).

The shield 64 desirably is generally formed in a shape to surround the pivotal leg 70 and to generally follow its contours. The shield 64 includes a retaining bar 94 (FIG. 2) which couples to and extends between the side walls 66 of the shield 64, which acts to urge and hold the pivotal leg 70 in a position in the shield 64 in which a substantial portion of the pivotal leg 70 rests between the sidewalls 66 of the shield 64 and against or closely adjacent the inner surface 34 of the first lid section 42 of the lid 25. The pivotal leg 70 is positioned in the shield 64 such that each end 73 of the pivotal bar 72 of the pivotal leg 70 extends through one of the elongated slots 68 to permit pivotable movement as well as forward and backward movement of the pivotal leg 70 within the shield 64, as shown in FIGS. 2-5 and 8. Such movement is further controlled by the pivotal coupling of the pins 74 on each end 73 of the pivotal bar 72 to the slots in the arms 62 of the yoke 60.

Figure 3:
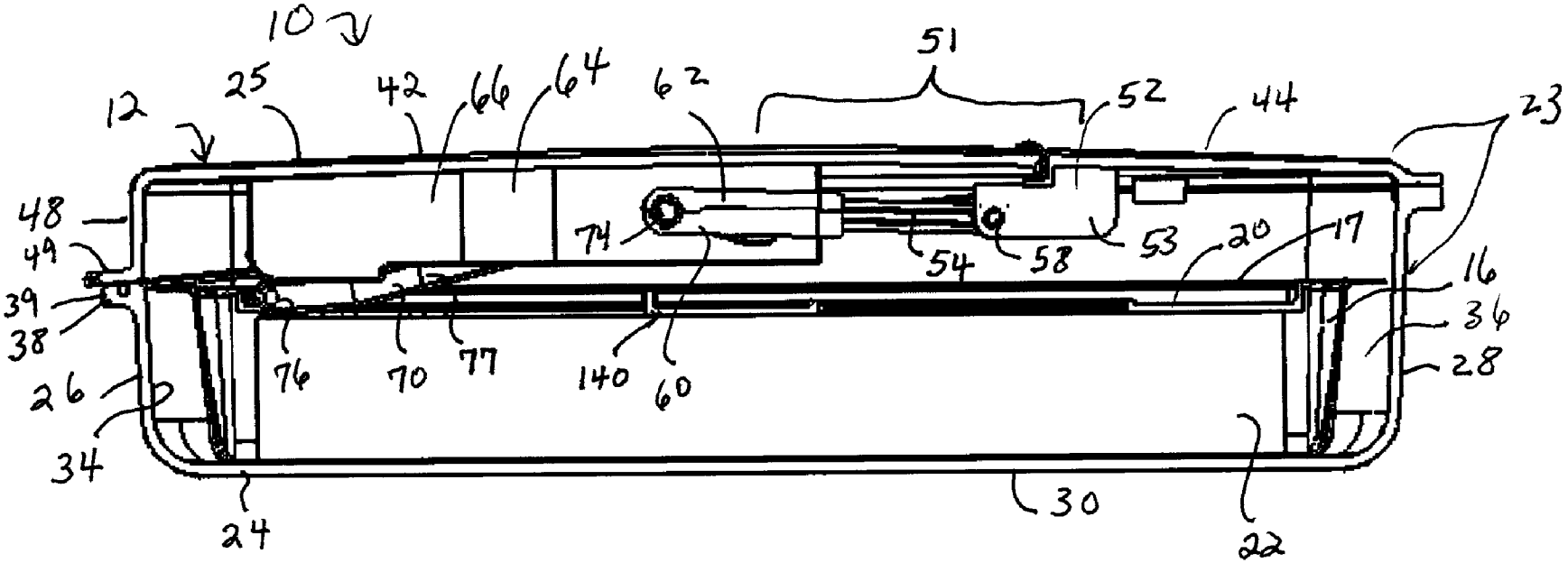
FIG. 3 is a sectional view of FIG. 1 taken along lines 3-3.
Figure 4:
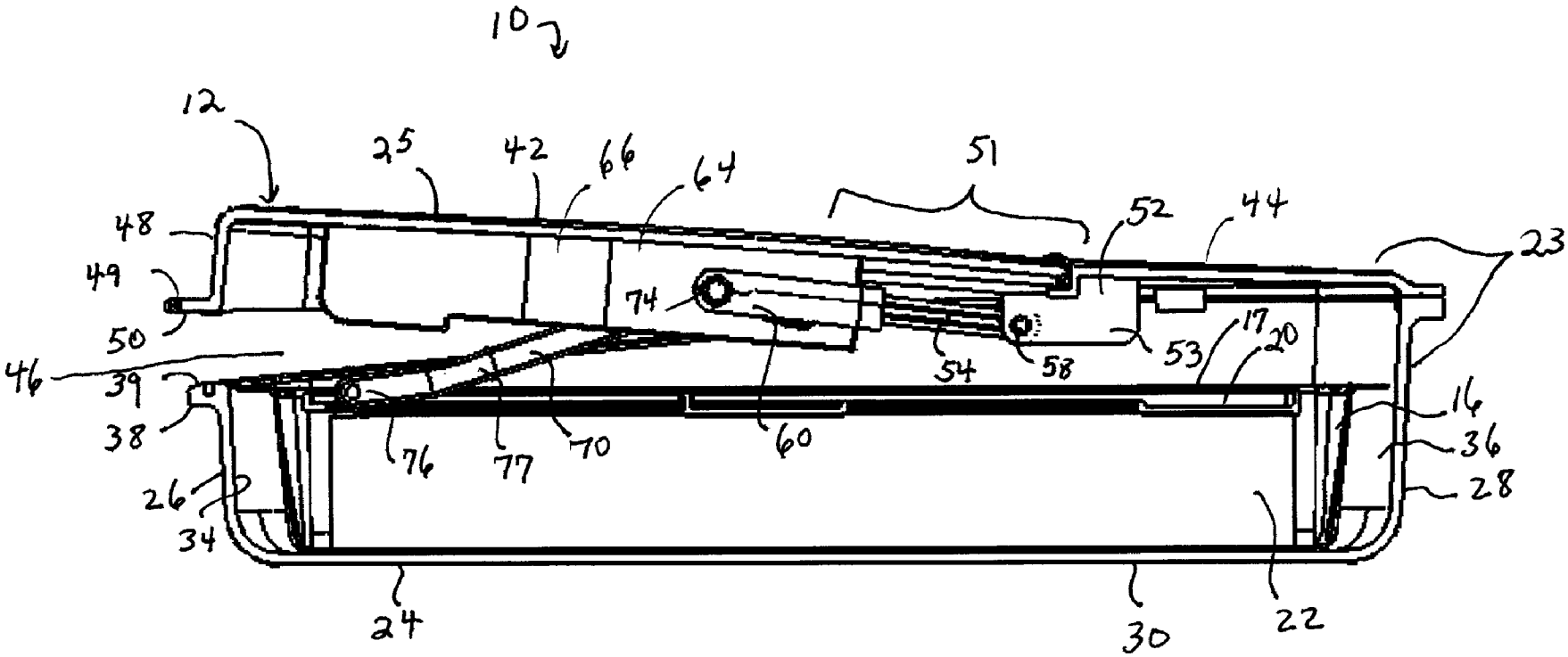
FIG. 4 is a sectional view similar to FIG. 3, but showing the lid opening and the sheet mover moving across a portion of a top sheet of sheet material.
Figure 5:
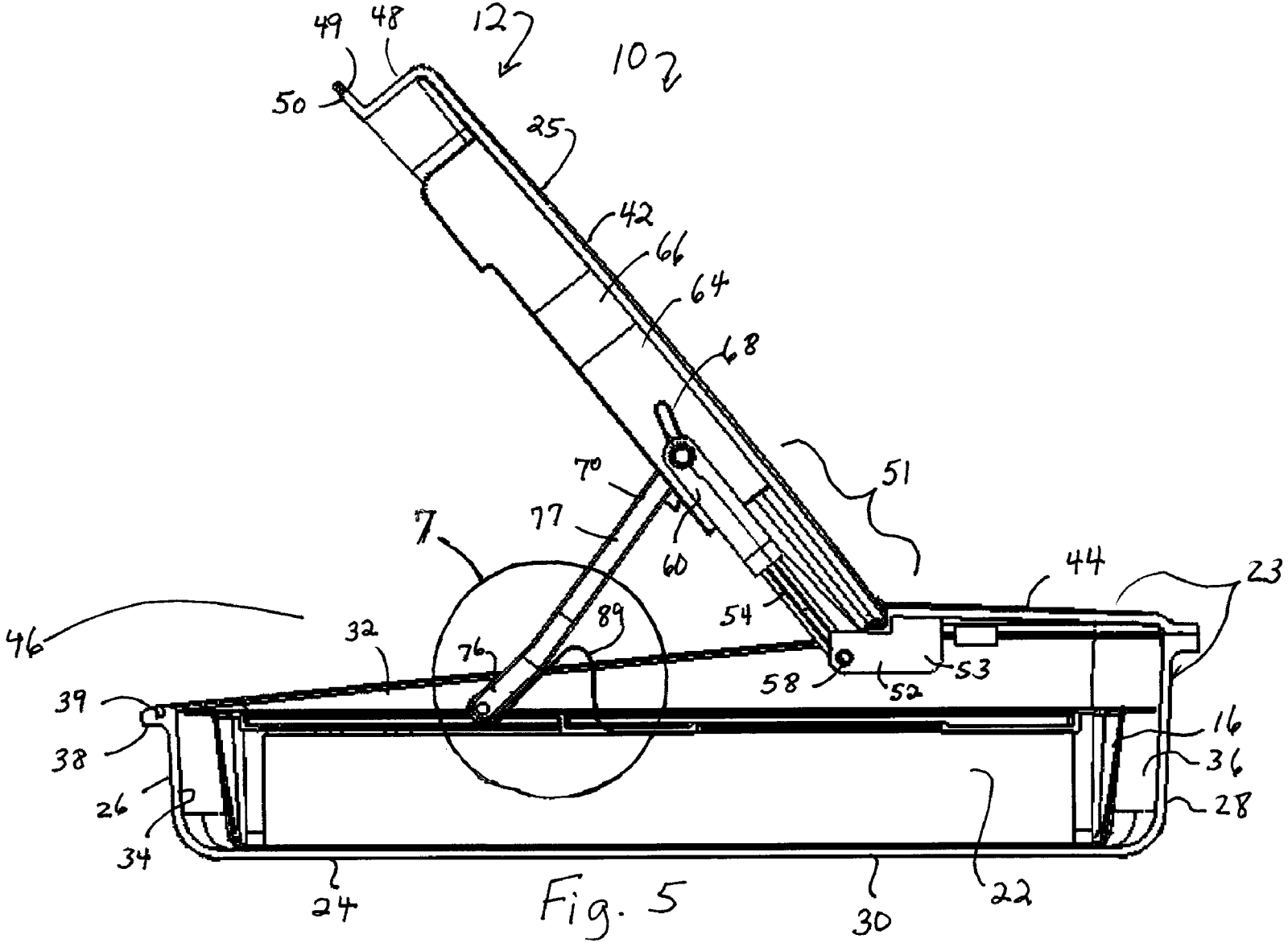
FIG. 5 is sectional view similar to FIG. 4, but showing the lid raised and a portion of the top sheet bunched or raised and moved upward by the sheet mover.
Figure 7:
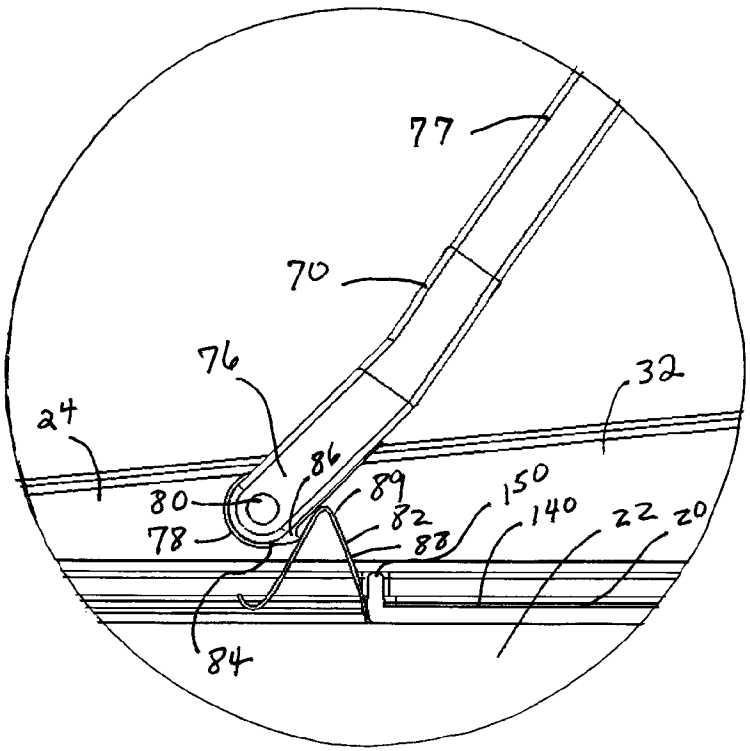
FIG. 7 is a partial sectional view of FIG. 5 taken generally along line 7 showing the pick on the toe of the sheet mover positioned and engaged against the portion of the top sheet and lifting the top sheet upward.
Figure 6:
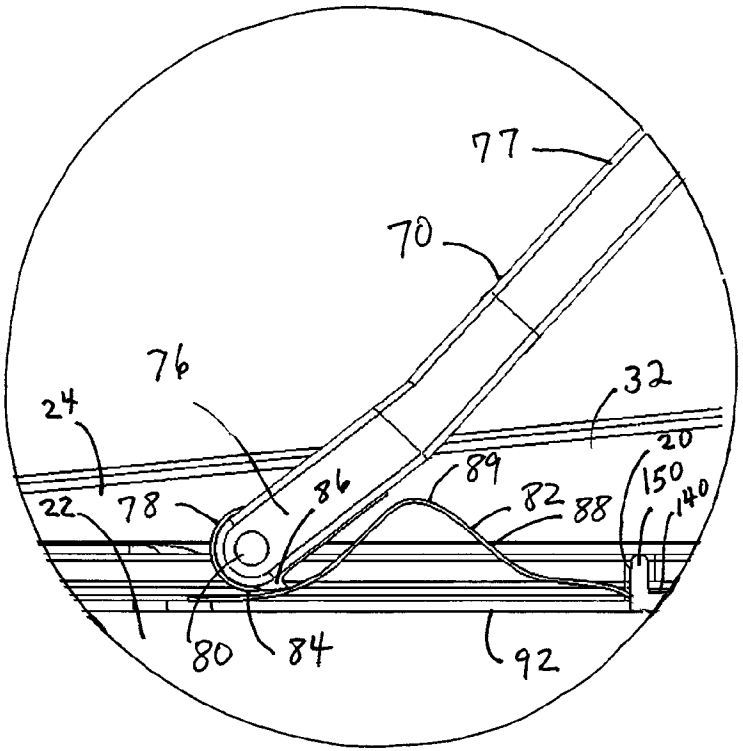
FIG. 6 is a partial sectional view, showing the toe of the sheet mover and the pick thereon moving over the top sheet and the pick grabbing or snagging the portion of the top sheet and moving the portion upward.
Figure 8:
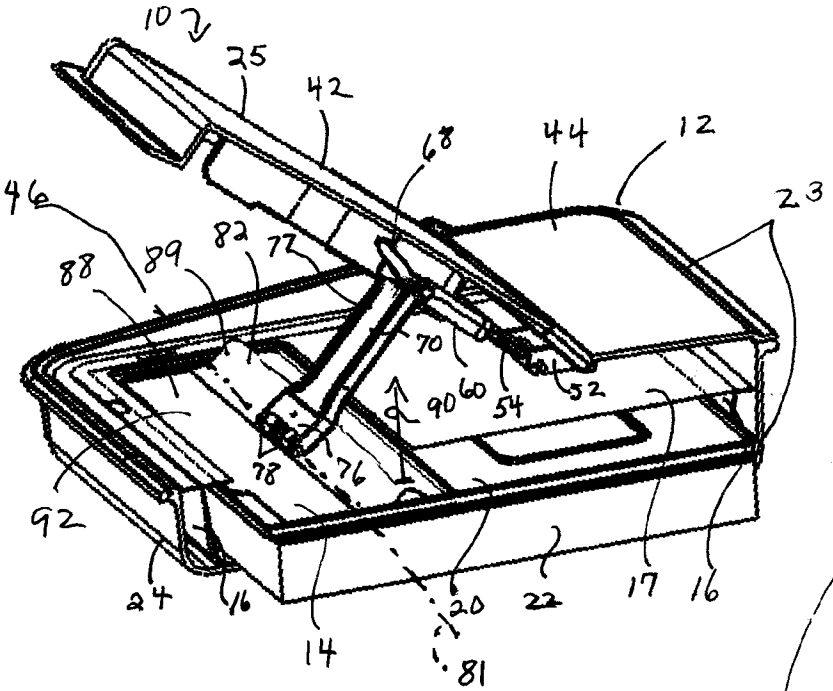
FIG. 8 is a perspective sectional view similar to FIG. 5 but showing the sheet mover moving the top sheet toward a portion of the restrictor and the next sheet positioned forward of the bunched and raised portion of the top sheet.
Figure 9:
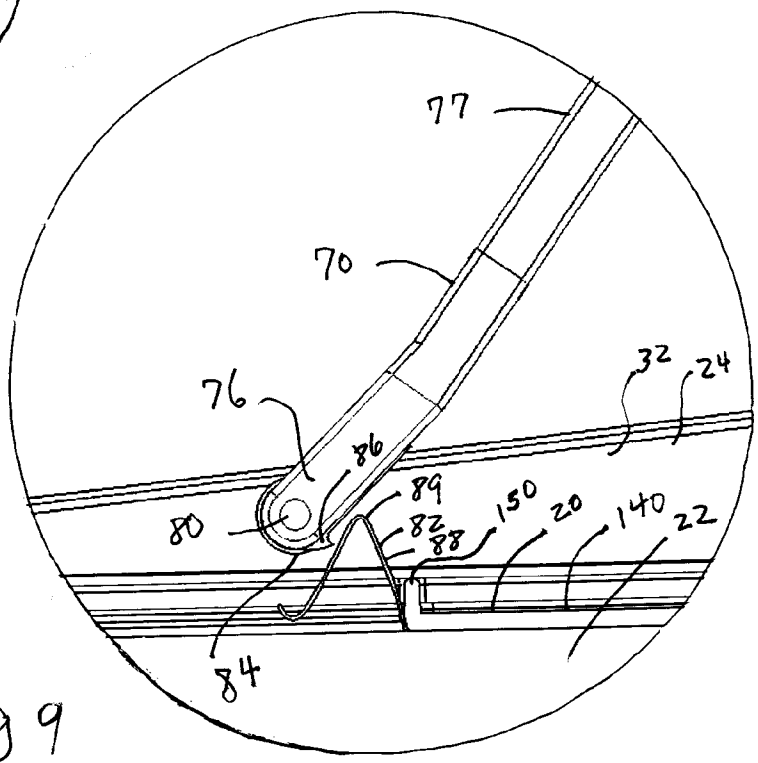
FIG. 9 is a partial sectional view of similar to FIG. 5 but showing the disengagement of movement away of the pick on the toe of the sheet mover.
Figure 10:
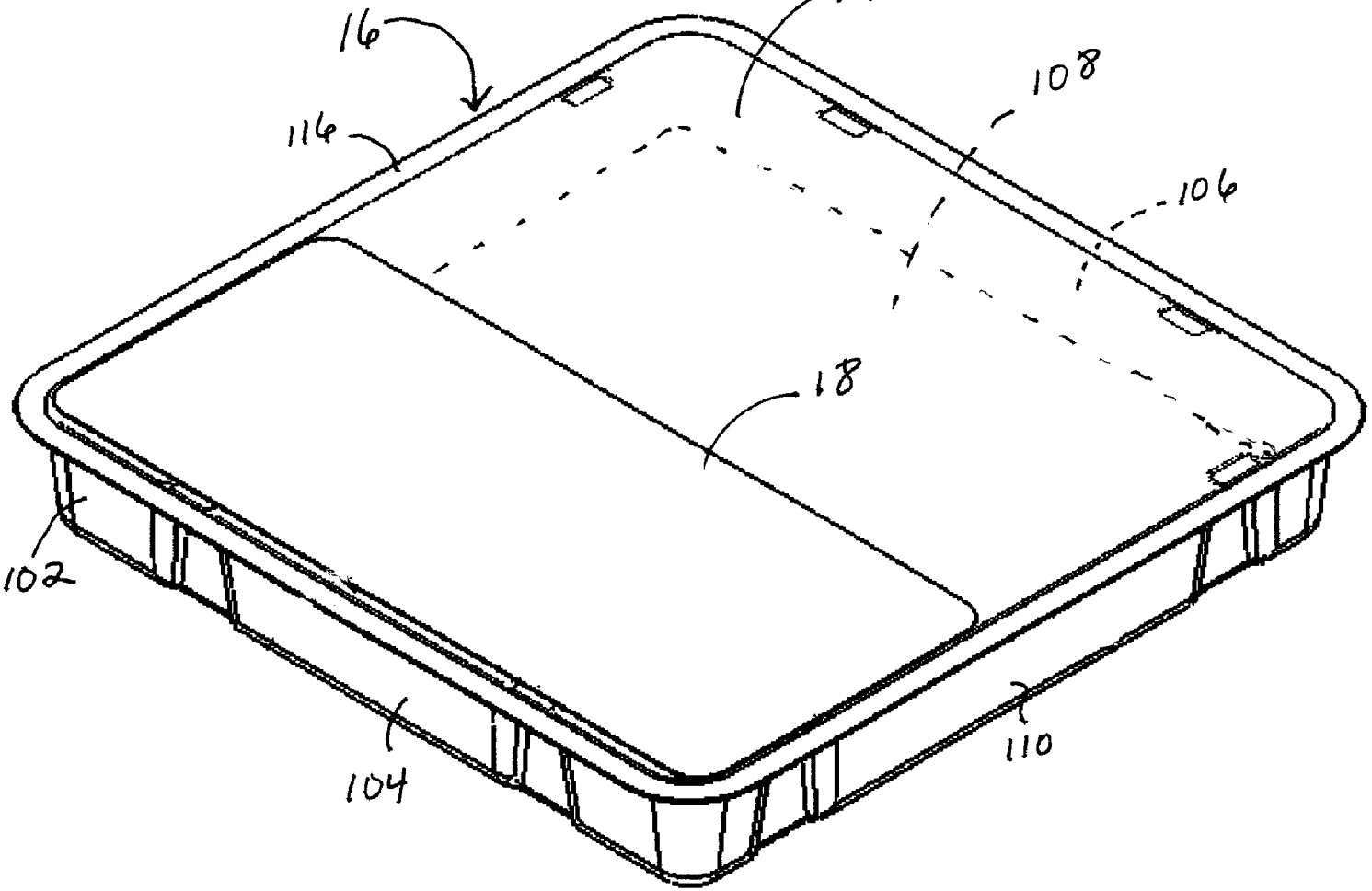
FIG. 10 is a perspective view of a cartridge having a cover and release sheet thereon.
Figure 11:
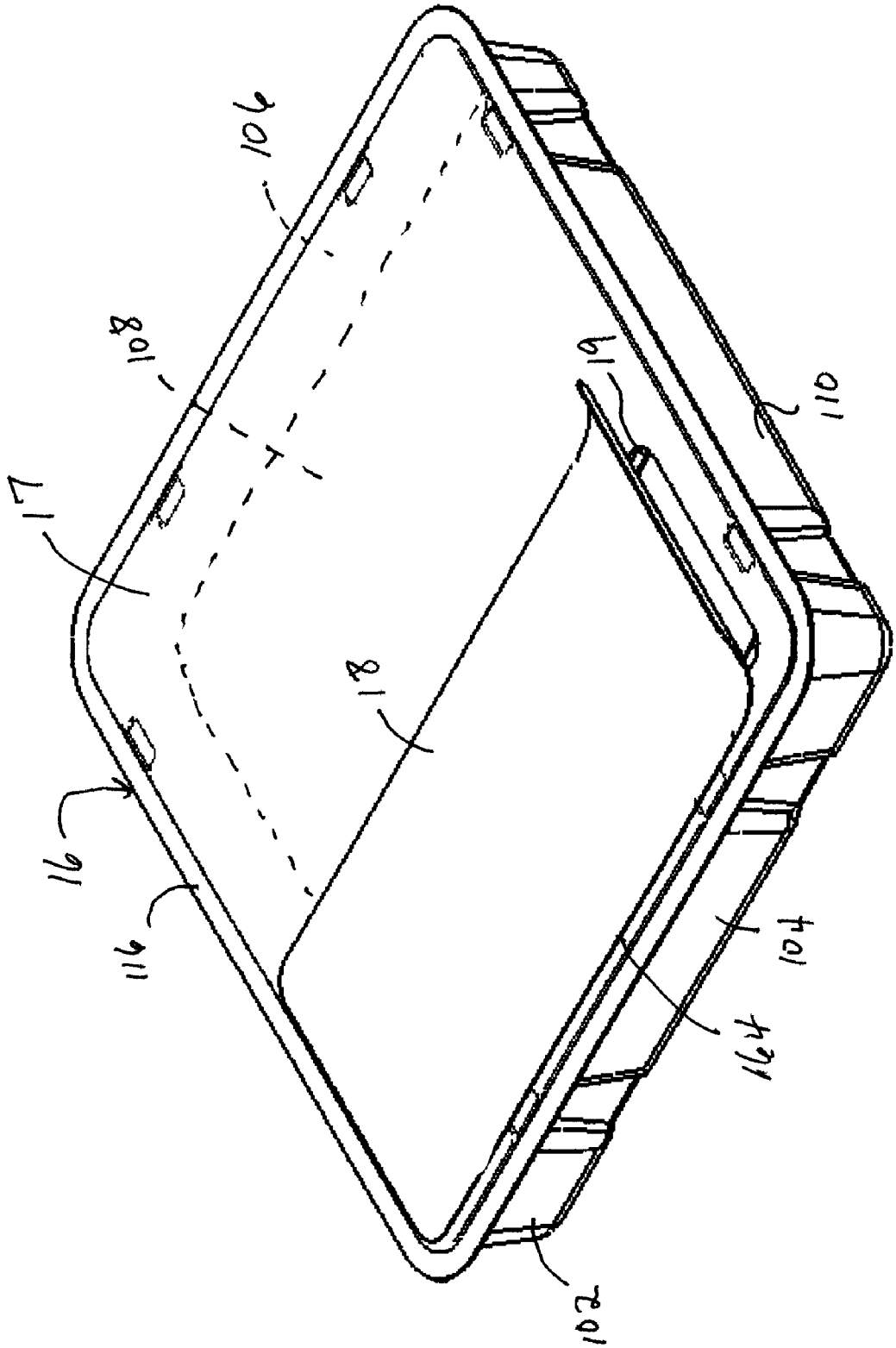
FIG. 11 is a perspective view similar to FIG. 10, but showing one end of the release sheet lifted for removal.
Figure 12:
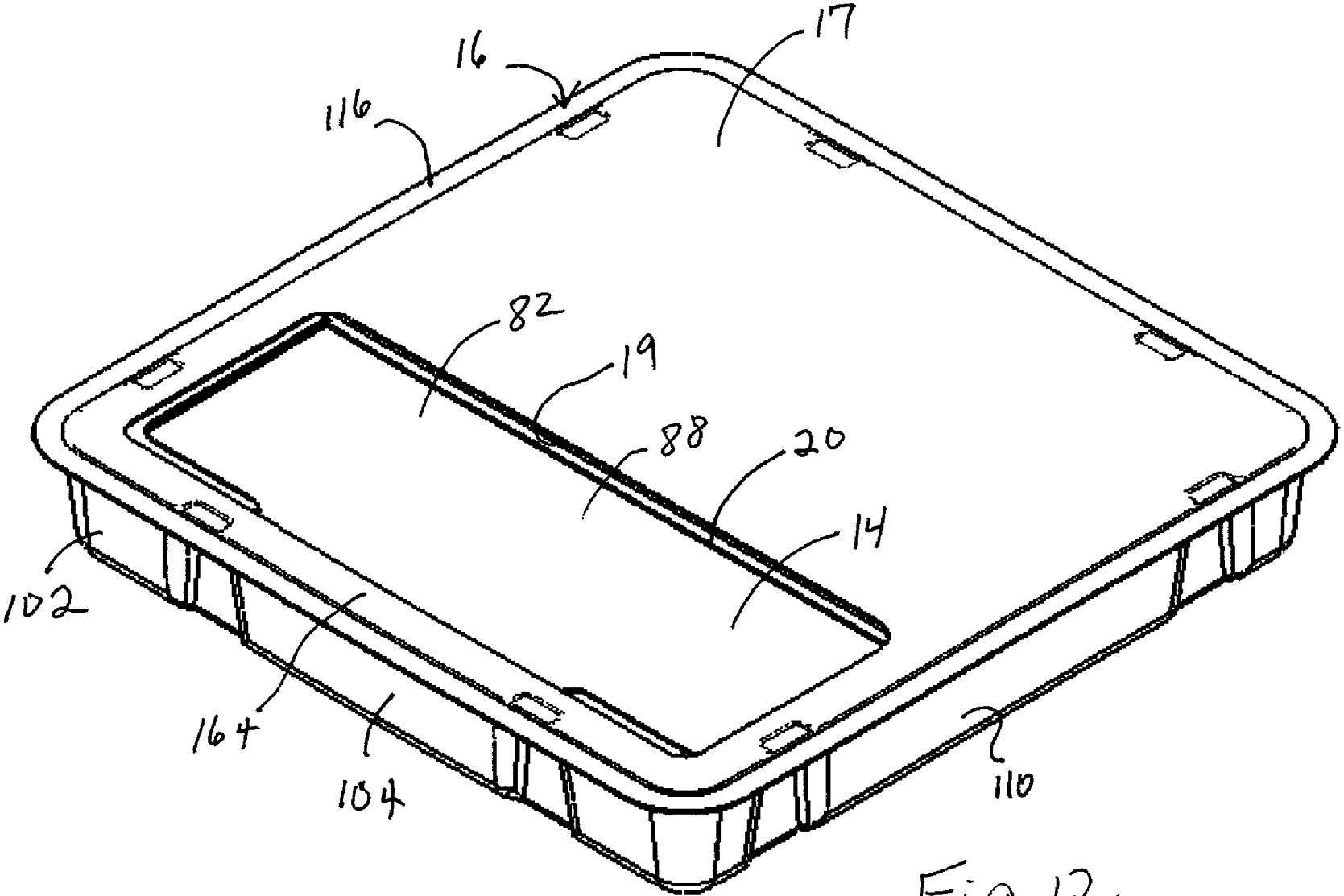
FIG. 12 is a perspective view similar to FIG. 11, but showing the release sheet removed from the cover and an opening in the cover which reveals a portion of a restrictor and a portion of the top sheet of the stack of sheet material contained in the cartridge.
Figure 13:
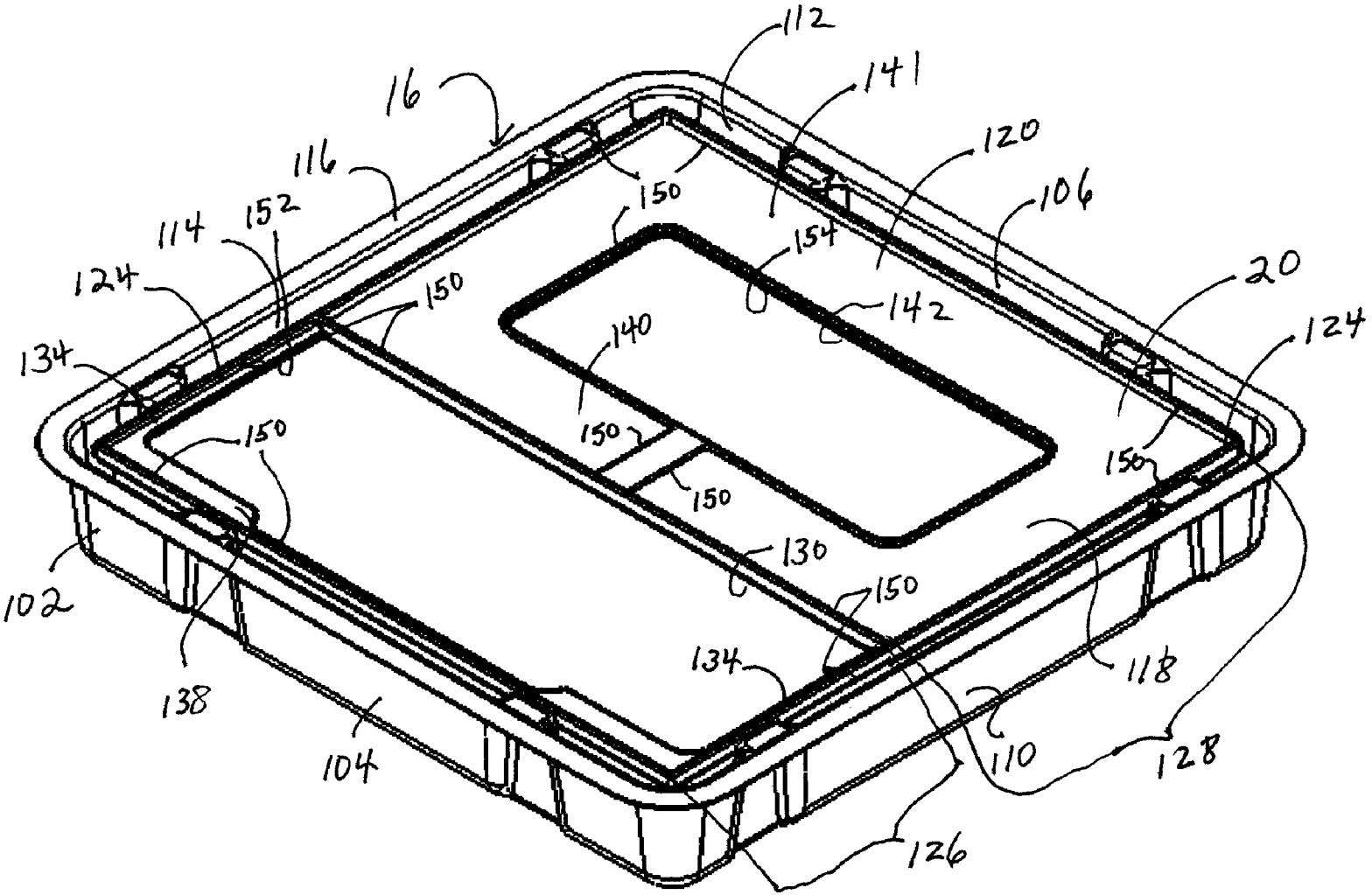
FIG. 13 is a perspective view similar to FIG. 12, but showing the cover removed and the restrictor positioned on the top sheet of the stack of sheet material contained in the cartridge.

As the first lid section 42 is raised in an opening direction 96, the yoke 60 moves over the pins 74 of the pivotal bar 72 which are positioned through the slots in the side arms 62 of the yoke 60 which provides a dwell period prior to the pivotal leg 70 being pulled rearward. This design ensures that the pivotal leg 70 can pivot or move through the range of movement needed to snag, grab or push the lowest or last sheet material 14 in the stack 22 of sheet materials 14, i.e. the last top sheet 82, before the pivotal leg 70 starts moving upward into shield 64 of the locking assembly 51. FIGS. 1 and 3 illustrates the first lid section 42 closed and the ends and pins 74 positioned forward in the elongated slot 68 in the sidewalls 66 of the shield 64. As first lid section 42 is opened, the yoke 60 is moved such that the ends and pins 74 therein move rearward in the elongated slot 68, as shown in FIGS. 4-5, at which time the pivotal leg 70 is pulled rearward and upward via movement of the ends of the pivotal bar 72 in the elongated slots 68 in the sidewalls 66 of the shield 64. When each pin 74 of the pivotal bar 72 of the pivotal leg 70 moves rearward in each elongated slot 68 of the shield 64, the attached yoke 60 and push rod 54 pull the pins 74 and the ends of the leg 70 rearward within the elongated slot 68 of the side walls 64 of the shield 64. This action also moves a portion of the body 77 (or ramp) of the pivotal leg 70 against the retaining bar 94 of the shield 64. These two actions cooperate to pull the pivotal leg 70 into the shield 64 of the locking assembly 51 when the first lid section 42 is raised higher in the opening direction 96 (FIG. 2). With the pivotal leg 70 completely held by the shield 64, the toe 76 and the pick 86 are positioned therein and are therefore moved away from a user's hand. The side walls 66 of the shield 64 are configured to extend beyond the toe 76 and the pick 86 when the pivotal leg 70 is received and/or held therein. This configuration protects a user's hand from being pricked by the pick 86. In addition, the pivotal leg 70 is moved out of the way so that additional sheet materials 14 or cartridge 16 may be added to the tray container 24 without the sheet material 14 getting snagged or grabbed by the pick 86 during insertion. When in a dispensing position, however, the locking assembly 51, namely, the rod holder 52, the pivot bar 56 and the shield 64 are configured to hold the pivotal leg 70 positioned such that the toe 76 and pick 86 of the pivotal leg 70 will contact and move sufficiently within the internal compartment 36 and against the top sheet 82 of the sheet material 14 contained therein to permit the pick 86 to snag or grab the lowest or last sheet in the stack 18 of sheet materials 14.

That is, when the first lid section 42 is moved in a closing direction 100 (FIGS. 2 and 3), this action permits the toe 76 of the pivotal leg 70 to move downward, out of the shield 64 and into its resting position against the new top sheet 82 of the stack 22 of sheet material 14. The toe 76 and pick 86 thereon are again in a position to move over the new top sheet 82 to snag or grasp another portion 89 of the new top sheet 82 for removal. The first lid section 42 and lid 25 desirably closes sufficiently against the tray container 24 such that evaporation of any moisture contained in the dispenser housing 23 is reduced or eliminated (FIG. 1).

The sheet material 14 used as a part of the system 10 is desirably, but not by way of limitation, contained in a stack 22 of sheet materials 14 disposed in a cartridge 16, as illustrated in FIGS. 8, 10-13 and 17-21. Such a cartridge 16 may include a tub 102 having a front wall 104, a back wall 106 which are spaced-apart and which intersect a lower end 108. A pair of spaced-apart side walls 110 intersect the lower end 108 as well and cooperate with the front and back walls 104, 106 to provide an inner surface 112 with defines an internal compartment 114 configured to hold the stack 22 of sheet material 14. The cartridge 16 includes an upper edge 116 and the cartridge desirably includes the cover which is coupled thereto. The cover 17 desirably includes the release sheet 19 positioned over the opening 20 in the cover 17. In this manner, when the cartridge 16 is positioned in the tray container 14, the release sheet 19 is removed and the opening is exposed so that the sheet mover or pivotal leg 70 may access the sheet material 14.

The cartridge 16 may alternatively be provided as a polymer or plastic package, having a seal or release sheet which is removable over an area which includes an opening or, alternatively, areas of weakness, such as perforations (not shown). In another alternative, the cartridge may include a plastic container having a lid or removable portion on at least a portion of a surface thereof. The cartridge may be formed from any material or combination of materials, and in any configuration, so long as the cartridge operates as shown and/or described herein.

The restrictor 20 may be used in conjunction with the dispenser 12, as illustrated in FIGS. 2, 6-9 and 12-21. The restrictor 20 acts to assist the dispenser 12 to permit one sheet material 14 at a time to be dispensed from the dispenser system 10. Further, the restrictor 20 desirably assists in holding sheet material 14 positioned in an aligned position in the stack 22 in the dispenser 12 or in a cartridge 16 from being displaced during shipping, delivery and/or dispensing.

The restrictor 20 operates to reduce or prevent double dispensing, that is, two sheet materials 14 dispensed together instead of one. Further, the restrictor 20 operates to reduce or prevent dispensing failure.

The restrictor 20 is desirably, but not by way of limitation, planar in configuration and desirably follows the configuration of the stack 22 of sheet material 14 upon which it rests, as shown in FIGS. 14-16. It desirably includes a body or plate 118 having an upper surface 120, a lower surface 122 and an outer perimeter 124. The restrictor 20 may also include a front portion 126 and a back portion 128.

The front portion 126 desirably includes an opening 130 formed through the restrictor 20 and sized and configured to permit the pivotal leg 70 to drop down and travel across the top sheet 82 which is exposed through the opening 130 in order to move the portion 89 of the top sheet 82 into a bunched, ruffled, wrinkled position to make it easy for a user to grasp the portion 89 and withdraw the top sheet 82 from the exit port 46 of the dispenser housing 23. The front portion 126 desirably provides a narrow outer perimeter 124 to assist in holding the edges 132 of the stack 22 of sheet materials 14 in a stacked and aligned orientation or position. Moreover, the perimeter 124 of the front portion 126 may be formed to include a narrow portion of the perimeter 124 on only one side 134, or, alternatively a narrow portion of the perimeter 124 may be formed on two sides 134. In the present embodiment, the perimeter 124 includes two narrow sides 134 and a narrow end portion 138 extending therebetween and positioned adjacent the front wall of the cartridge 104 or dispenser 26. In another alternative (not shown), the front portion 126 is not provided, and only the back portion 128 provides the restrictor 20. When the front portion 126 is included as a portion of the restrictor 20, as illustrated in the present embodiment, it desirably assists in positioning and holding the back portion 128 into a desirable position to permit the restrictor 20 to operate to reduce or eliminate dispensing problems.

The back portion 128 is desirably heavier in weight than the front portion 126, and is desirably about twice the thickness thereof. The back portion includes a holder 140 which extends transversely across the length of the restrictor 20 and is formed along a front of the back portion 128. The holder 140 acts as a holding area in to hold the portion 89 of the top sheet 82 when the portion 82 is snagged or moved against the holder 140 such that the portion 89 bunches or ruffles in the direction 90 upward.

The back portion 128 includes a wide perimeter edge 141 which extends about the perimeter in a general U-shape from one side of the holder 140 to an opposite side. The U-shaped is formed, in part, by an opening 142 which is formed through the center of the back portion 128. The opening 142 may be, but not by way of limitation, provided as a smaller opening relative to the opening 130 in the front portion 126. The opening 142 desirably provides a "relief zone" for the next sheet 92 in that if a portion of the next sheet 92 is pulled along with the top sheet 82 when the top sheet 82 is being dispensed, the portion of the next sheet 92 which is pulled is generally held in the opening 142 which assists in preventing double dispensing and/or jamming or wadding of sheet material 14 in the stack 22 when one sheet 14, i.e., the top sheet 82, is being dispensed. While the back portion 128 desirably includes the wide perimeter edge 141, it will be understood that, alternatively, the back portion may be formed as a solid component without an opening (not shown).

Certain types of sheet material 14 may slide easily, and have a low surface tension. Adding, desirably, isopropyl alcohol and/or other liquids as a moistening solution to premoisten the sheet material 14 in the dispenser 12 and/or the cartridge 16 results in greatly reduced surface tension between the sheets 14. Therefore, the sheet material 14 greatly resists staying in alignment, whether dry or premoistened. Increased slippage of sheet material 14 results in wadding of sheet material 14 leading to inadequate dispensing, excessive dispensing and/or dispensing failure. In addition, the liquid may cause some sheets 14 in the stack 22 to stick or clump together. These same sheets 14 may also slip out of alignment in the stack 22. The restrictor 92 acts to reduce or eliminate these problems.

The back portion 128, while thicker than the front portion 126 as described, also may include, but not by way of limitation, a step 146 on the lower surface of the restrictor 20, due to its increased thickness. That is, the step 146 may position the lower surface 122 of the front portion 126 of the restrictor 20 a small distance from the top sheet 82 in the area where the front portion 126 and the back portion 128 are joined or integrally formed together. Alternatively, the step may be removed and the lower surface of the restrictor tapered (not shown).

The restrictor 20 provides both weight and structure to prevent movement of the sheet material 14. It will be understood that desirably at least about 60 percent of the weight of the restrictor is in the back portion 128. Even more desirably, at least about 70 percent of the weight of the restrictor is in the back portion 128. Even more desirably, at least about 80 percent of the weight of the restrictor is in the back portion 128. Yet even more desirably, at least about 90 percent of the weight of the restrictor is in the back portion 128.

In addition, the weight of the restrictor 20 is desirably in a range from about 30 grams to about 70 grams. Desirably, the weight of the restrictor is in a range of about 40 grams to about 60 grams. Even more desirably, the weight of the restrictor is in a range of about 45 grams to about 55 grams. Yet even more desirably, the weight of the restrictor is in a range of about 48 grams to about 52 grams.

The restrictor 20 is desirably provided in any shape or configuration so long as the restrictor operates as shown and/or described. The restrictor 20 may be provided, as previously noted, with only the back portion 128 (not shown). In this alternative, the dispenser 12, the restrictor 20 and/or the cartridge 16 may include a rib, other mechanical member, and so forth, to prevent the restrictor from slipping forward. The restrictor 20 provides improved dispensing when the weight of the restrictor 20 prevents the perimeter edges 132 of the sheet materials 14, which may have been heat and/or laser sealed, and so forth, from snagging edges 132 of adjacent sheet materials 14 when the top sheet 82 is being withdrawn and dispensed. The relief zone or opening 142 of the back portion 128 functions to hold any snagged sheets 14 in a position which prevents double dispensing or jamming.

While the restrictor 20 may be provided separately, or it may be provided as a component of the dispenser 12 (not shown), the restrictor 20 may also be provided in a cartridge 16 which may be filled with sheet materials 14. In this instance, the restrictor 20 may desirably include a plurality of ribs 150 provided on the upper surface 120 thereof. The ribs 150 may be provided in any portions of either upper and/or lower surface 120, 122. In the present embodiment, the ribs 150 are generally formed adjacent to the outer perimeter 124 and adjacent at least a portion of an outer perimeter 152 of the opening 130 in the front portion 126 and the perimeter 154 of the opening 142 in the back portion 128. Additional ribs 150 may be provided in a spaced-apart configuration and positioned generally transversely on the holder 140. It will be understood that other positions of the plurality of ribs are possible.

The plurality of ribs 150 are provided to assist in supporting the cover 17 which is desirably coupled in an air-tight configuration and/or sealed to the upper edge 116 of the cartridge 16 so that liquid which is used to premoisten the sheet material 14 does not evaporate, as shown in FIGS. 17-21. Too much air in the cartridge 16 causes the cover 17 of the cartridge 16 to balloon or expand somewhat. It also encourages the sheet material 14 in the stack to move and become unaligned. Further, when the cartridges 16 are stacked on top of each other in a box or container for transport, pressure from one cartridge 16 stacked on top of another may cause the air in each cartridge 16 to cause the cover 17 to break open or the seal provided by the release sheet 18 to break or rupture, resulting in evaporation of the liquid in each cartridge 16.

The plurality of ribs 150 may extend transversely upward from the upper surface 120 of the restrictor 20 to assist in supporting the cover 17 on top of the stack 22 of sheet materials 14. That is, the height of the ribs 150, when on top of the full stack 22, are about the same height as the upper edge 116 of the cartridge 16. When the restrictor 20 is in place, the stack 22 cannot by overly compressed, nor can the air contained within the internal compartment 114 of the cartridge 16. This design of the restrictor 20 assists in preventing leakage of air and spillage or evaporation of liquid from the cartridge 16 since it greatly reduces and prevents breakage or openings in the cover 17 or release sheet 18 caused by compression or displacement of air, sheet material or liquid. The restrictor 20 also assists in holding the sheet materials 14 in an aligned stack 20 and reduces or prevents displacement and/or misalignment of the sheet materials 14 in the stack 22 during shipment.

FIGS. 17-21 illustrate the common manner of packing a plurality of cartridges 16 in a box or container (not shown) for shipping. Often, but not by way of limitation, the cartridges 16 may be stacked six cartridges one on top of another. The plurality of ribs 150 on the upper surface 120 of the restrictor 20 operate to support each cartridge 16 one on top of the other without breaking or causing unwanted openings to form in the cover 17 or the seal of the release sheet 18. The sheets 14 are supported in the stack 22 in their proper aligned position.

The cover 17 of the cartridge 16 may interact with the restrictor 20 as well. The opening 19 in the cover 17 corresponds generally, but not by way of limitation, to the size, shape and location of the opening 130 in the front portion 126 of the restrictor 20 such that a push zone or pick zone 156 (collectively a pick/push zone) is provided for the pivotal leg 70 to move downward through the opening 19 in the cover 17 and the opening 130 in the front portion 126 of the restrictor 20 so that the leg 70 may contact and move across the top sheet 20 to move, pick, bunch, wrinkle, snag, and so forth the portion 89 within this zone 156.

The weight of the back portion 128 provides both weight, compression and friction to a back 158 of the stack 20 of sheet materials 14 so that movement of the back 158 of the stack or a portion of a sheet 14 in the back 158 is restricted. In this manner, double dispensing, snagging of sheets 14 together and/or streaming may be reduced or prevented. The front 160 of the stack 22 does not compress so that the top sheet 82 is readily picked or snagged and the portion 89 is provided in the pick zone 156 so that the portion 89 can be easily and readily grasped by a user and removed from the cartridge 16 and through the exit port 46 of the dispenser 12.

When the release sheet 18 is removed from the cover 17 to expose the opening 19 and the cartridge 16 of sheet materials 14 is disposed in the dispenser 12, the cover 17 may operate to interact with the restrictor 20 to assist in dispensing. That is, when the pivotal leg 70 snags and bunches the portion 89 of the top sheet 82 for withdrawal of the top sheet 82 from the cartridge 16 and the exit port 46 of the dispenser 12, the restrictor 20, especially the front portion 126 thereof, may lifts up during the withdrawal of the top sheet 82 from the dispenser 12. The opening 19 in the cover 17 is desirably sized smaller than the front portion 126 of the restrictor 20. Therefore, if the front portion 126 of the restrictor 20 lifts when the top sheet 82 is being withdrawn by a user, the surrounding cover 17 acts to hold the restrictor 20 in a position within the cartridge 16 so that the restrictor 20 continues to be generally positioned for operation over the stack 22 of sheet materials 14. Alternatively, the weight of the restrictor 20 may be adjusted to hold the restrictor 20 in a position in the dispenser 12 or cartridge 16. In another alternative, for example, but not by way of limitation, ribs or tabs may be provided in one or more walls or positions in the dispenser or the cartridge to limit movement of the restrictor during dispensing (not shown).

In a method of using a restrictor positioned in a cartridge with a dispenser, the dispenser 12 described herein, or an equivalent (not shown), is provided, as shown in FIGS. 1-9. Desirably, a cartridge 16 containing a stack 22 of sheet materials 14 is provided. More desirably, a restrictor 20 is provided positioned on the top of the stack 20 is provided (FIGS. 10-13). The cartridge may include a cover 17 having a release sheet 18 positioned over an opening 19 therein. Desirably, the release sheet 18 is removed from the cover 17. The first lid section 42 of the lid 25 is raised and the cartridge 16 is positioned in the internal compartment 36 of the dispenser housing 23 with the opening 19 in the cartridge 16 positioned adjacent the front wall 26 of the dispenser housing 23.

The lid 25 is closed over the tray container 24 (FIGS. 1 and 3) and when a user desires to obtain a sheet material from the dispenser 12, the user raises the first section 42 of the lid 25. The first lid section 42 is raised in an opening direction 96 (FIGS. 2-9) and this action causes the pivotal leg 70 to move across the top sheet 82 in the pick zone 156. The toe 76 of the pivotal leg 70 contacts and maintains this contact while moving across the top sheet 82 in a direction 162 until the toe 76 rotates slightly which positions at least one pick 86 against the top sheet 82 such that the pick 86 snags or grabs the portion 89 of the top sheet 82 and pushes the portion 89 against the holder 140 of the restrictor 20 and raises the portion 89 of the top sheet 82 in the upward direction 90 such that it causes an upward bunch, ruffle, wrinkle, and so forth of the portion 89. The pivotal leg 70 is moved by the locking assembly 51 such the pick 86 on the toe 76 of the pivotal leg 70 detaches from the portion 89 of the top sheet 82. As this occurs, the front portion 126 of the restrictor 20 may raise upward. If this occurs, the front end 164 of the cover 17 of the cartridge 16 acts to hold the restrictor 20 in position so that the restrictor 20 is not further lifted or moved in the cartridge 16. Further, when the top sheet 82 is removed by a user, the portion of the top sheet 82 resting under the back portion 128 of the restrictor 20 will be moved out from under the back portion 128 and dispensed through the opening 130 in the front portion 126 of the restrictor 20, and through the opening 19 in the cover 17 of the cartridge 16 and through the exit port 46 of the dispenser 12. When this occurs the restrictor 20 acts to positioned at least a front of the next sheet 92 in a substantially flat position while a back portion of the top sheet 82 is pulled from underneath the back portion 128 of the restrictor 20. In addition, when the portion 89 of the top sheet 82 is grasped and pulled through the opening 130 in the front portion 126, this action may also cause the front portion 126 of the restrictor 20 to move upward. Again, the front end 164 of the cover 17 may operate to limit movement of the restrictor 20. Movement of the restrictor 20 may be limited by other means or mechanisms shown and/or described herein, or known in the art.

EXAMPLE

Figure 22:
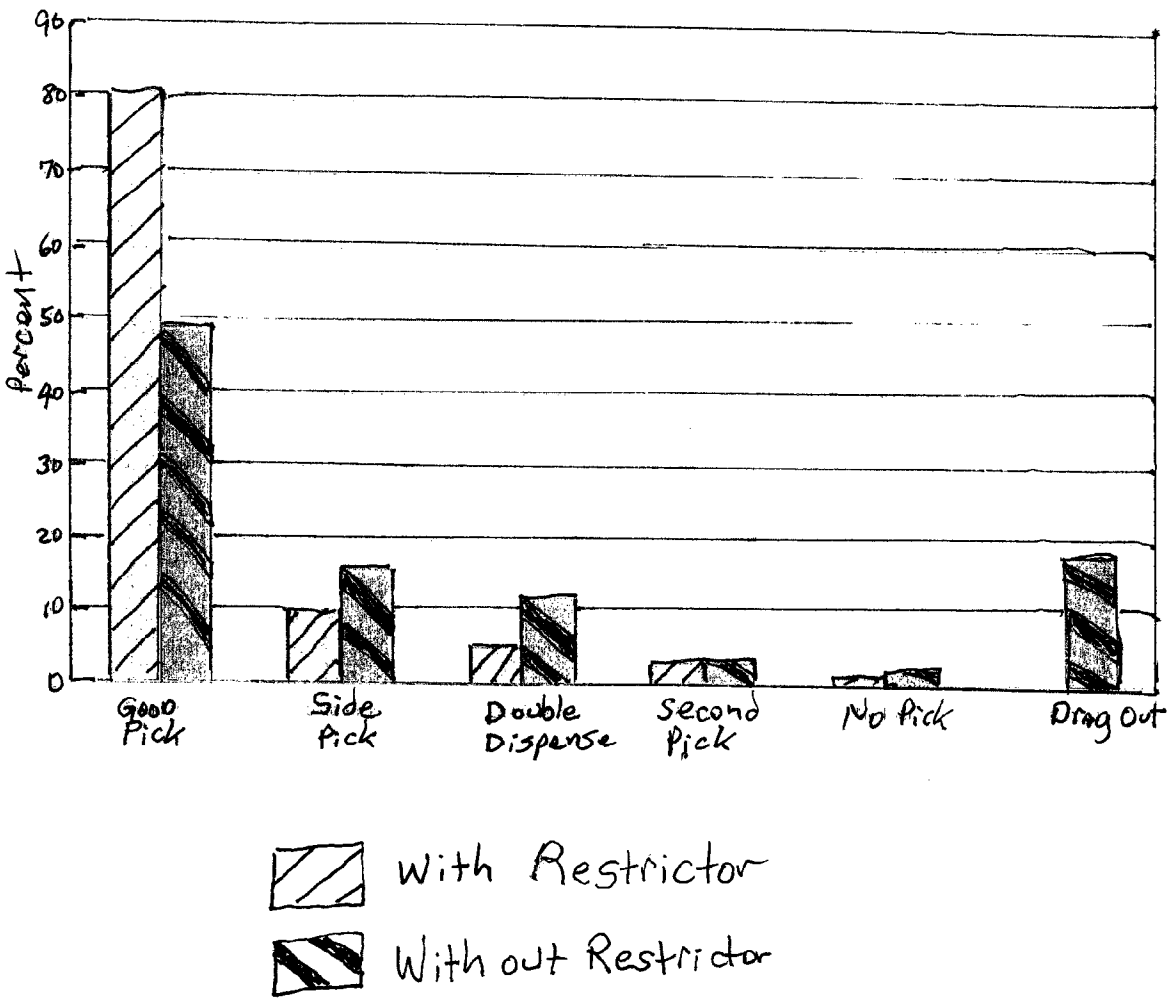
FIG. 22 is a bar graph showing the results of dispensing sheet material without a restrictor and with a restrictor from the dispenser.

Referring now to FIG. 22, which illustrates the results of using the dispenser described herein with and without the restrictor.

Three hundred (300) sheet materials were provided separately in six (6) cartridges, each of which had fifty (50) wipes contained therein, for a total of 300 wipes. The wipes each comprised a woven polyester material, and were aligned in a stack in each cartridge, and the opened cartridge was positioned in the dispenser shown and described herein without a restrictor. The 300 sheet materials were premoistened with isopropyl alcohol. The room temperature was about 75 degrees (plus or minus 5 degrees); the relative humidity was about 50 percent (plus or minus 5 percent). The 300 sheets were then dispensed from the dispenser in the manner described previously herein.

Of that amount, about 48 percent were "picked" or "pushed" as shown and described in detail herein, which resulted in successful dispensing to a user. About seventeen (17) percent were side picked, resulting in a smaller ruffled, wrinkled portion adjacent one side of a front portion of the tray container. About twelve (12) percent of attempted dispenses resulted in two sheets being lifted and dispensed together. About three (3) percent of attempted dispenses did not snag or move the top sheet on the first attempt, and a second attempt was required to obtain a top sheet. About two (2) percent of attempted dispenses resulted in no sheet dispensed in spite of two or more attempts to dispense a sheet material. Drag out, that is, a dispensing of the top sheet and the next sheet being moved out ("dragged out") with the top sheet even though the next sheet was not directly snagged or moved by the pivotal leg. About eighteen (18) percent of the dispenses resulted in drag out of the next sheet along with the top sheet.

Five hundred (500) sheet materials were provided separately in ten (10) cartridges, each of which had fifty (50) wipes contained therein, for a total of 500 wipes. The wipes each comprised a woven polyester material identical to the woven polyester material used in the test of 300 wipes without a restrictor. The wipes were aligned in a stack in each cartridge, and the opened cartridge was positioned in the dispenser shown and described herein with the restrictor. The 500 sheet materials were premoistened with isopropyl alcohol. The room temperature was about 75 degrees (plus or minus 5 degrees); the relative humidity was about 50 percent (plus or minus 5 percent). The 500 sheets were then dispensed from the dispenser in the manner described previously herein.

Of that amount, about eighty two (82) percent were "picked" or "pushed" as shown and described in detail herein, which resulted in successful dispensing to a user. About ten (10) percent were side picked, resulting in a smaller ruffled, wrinkled portion adjacent one side of the front portion of the restrictor. About five (5) percent of attempted dispenses resulted in two sheets being lifted and dispensed together. About three (3) percent of attempted dispenses did not snag or move the top sheet on the first attempt, and a second attempt was required to obtain a top sheet. About one (1) percent of attempted dispenses resulted in no sheet dispensed in spite of two or more attempts to dispense a sheet material. Drag out, that is, a dispensing of the top sheet and the next sheet being moved out ("dragged out") with the top sheet even though the next sheet was not directly snagged or moved by the pivotal leg. There were no episodes of drag out when the restrictor was used.

A comparison of these events illustrates that use of the restrictor resulted in about a sixty-five (65) percent improvement of episodes of a "good pick" which resulted in a dispensed sheet on the first attempt. The use of the restrictor reduced incidences of double dispensing by about fifty-eight (58) percent. The use of the restrictor resulted in a one-hundred (100) percent reduction in drag out (which results from the snagging of sheets).

For the system 10 it will be understood that the pick is not required to push the sheet material away from a stack of sheet materials, or away from adjacent sheet materials. Rather, a pusher, that is, the end of the toe which is configured to cause friction against the top sheet may be used instead to move the top sheet away from the stack of sheet materials or adjacent sheet materials. The term "sheet mover" as used herein is intended to encompass both the "pick" and the "pusher" as well.

The system 10 may be positioned adjacent and secured to a support surface (not shown) via a mounting bracket. Such a mounting bracket is disclosed in U.S. Pat. No. 6,533,145 to Richard P. Lewis, et al., which is hereby incorporated by reference herein for all purposes. Other mounting apparatus may be used as well. For example, the dispenser may have an adhesive thereon for holding it in place. Alternatively, the adhesive is a cohesive adhesive wherein both a portion of the dispenser and the support surface have some cohesive adhesive thereon. Mechanical fasteners, suction cups, hook and loop materials, and so forth may be used, and are provided herein as non-limiting examples. It will be understood that any apparatus known to those skilled in the art may be used.

It will be appreciated that the system 19 may, alternatively, be constructed to be a one-use, disposable system. Therefore, when all sheet materials are removed from the dispenser, the dispenser is thrown away or disposed of. In clean room-type situations, this may be desirable, to cut down on contamination by lint, dust, and so forth.

The sheet material (premoistened or dry) may include one or more materials, such as, but not by way of limitation, meltblown fibers, spunbond fibers, polyester, spunlace, cellulose, and so forth. The sheet material may be provided as dry sheet material, and may be dispensed as dry sheet material. A liquid solution may be added to the sheet material, either before or after it is inserted into a dispenser. Such liquid solution may include, alone or in combination, but not by way of limitation, isopropyl alcohol, deionized water, and so forth.

The sheet materials 14, stack 22 of sheet materials 14, cartridge 16 and/or restrictor may be provided in any shape, or combination of shapes and configurations. The sheet material may be provided as symmetrical sheet material, or asymmetrical sheet material. Similarly, the dispenser housing 23 may be provided in any configuration, so long as such configuration permits sheet material to be inserted therein to be dispensed therefrom.

The cartridge 16 may comprise one or more of the features or characteristics of the dispenser. For instance, the cartridge may include a housing having a portion which is pivotably movable and a pivotal leg/sheet mover coupled thereto. The cartridge may be positioned in a separate, outer housing for dispensing.

Similarly, the pick, pusher and/or locking assembly shown and/or described herein may be constructed separately and supplied to a dispenser housing 23 or a cartridge. Such a pick, pusher and/or locking assembly may be constructed from any suitable material that operates as described herein. Such materials may includes plastic, rubber, metal, bristles (natural or synthetic), and so forth.

The dispenser 12 may be constructed from any suitable material or combination of materials. Such materials include, but are not limited to, plastic, metal, paper, fiber, wood, and so forth; combinations of these materials may be used together as well. If the dispenser 12 is configured to be a non-refillable, single use, disposable dispenser, it may be constructed from suitable materials for disposal, including, but not limited to, paper, paperboard, plastic, fiber, metal, and so forth. Similarly, combinations of these materials may be utilized. The restrictor is desirably formed from any material or combination of materials, especially, however, those material(s) which are unaffected by long term exposure to a liquid, such as isopropyl alcohol, and so forth. For example, but not by way of limitation, the restrictor may be formed from a plastic, and more desirably, formed from HDPE, polypropylene, styrene, acetyl and so forth. Alternatively, the restrictor is formed from any material and in configuration which permits it to operate as shown and/or described herein.

Moreover, the configuration of any component shown and/or described herein is intended as only non-limiting examples. It will be appreciated that any feature(s) in any embodiment shown and/or described herein may be used, substituted and/or combined with any other feature(s) in any other embodiment.

While certain characteristics are described in specific embodiments, any one or more characteristics, features, and/or elements may be used in any combination in any embodiment, or to create a particular embodiment from the disclosures, teachings, and/or suggestions provided herein. While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A system for dispensing a stack of sheet material, the stack having a top sheet positioned at an upper end of the stack of sheet material and a next sheet positioned under the top sheet, the system comprising:

a dispenser comprising a housing including a container and a lid which cooperate to provide an inner surface formed to include an internal compartment configured to hold sheet material, the housing including an exit port for withdrawal of sheet material therefrom, the dispenser including a sheet mover mounted to the housing and configured to move sheet material positioned in the housing, such that when the lid is lifted, a portion of the sheet mover contacts at least a portion of a sheet material positioned in the housing and moves in one direction across and against the portion of the sheet material such that the portion of the sheet material is at least briefly coupled to the portion of the sheet mover and is moved in the one direction, then the sheet mover reverses direction and moves in an opposite direction and towards the lid as the lid is lifted, wherein the portion of the sheet material is moved at least in the one direction, and wherein the portion of the sheet material moved is positioned to be easily withdrawn through the exit port by a user; and a restrictor comprising a body configured to be positioned on top of and across a back of a top sheet of a stack of sheet material disposed in the dispenser, wherein when the dispenser is activated to remove sheet material therefrom, the body permits the top sheet to be dispensed from the dispenser, the body configured to limit movement of the back of the top sheet and the next sheet such that when the top sheet is moved away from the next sheet and dispensed, a front of the next sheet is positioned in a substantially flat position such that the next sheet becomes a new top sheet and it is positioned for dispensing when the dispenser is again activated.

2. The system of claims 1, wherein the body includes a plate having an upper surface, a lower surface and an outer perimeter.

3. The system of claim 2, wherein the outer perimeter is configured to substantially cover an outer perimeter edge of at least the back of the top sheet.

4. The system of claim 2, wherein the body includes a front portion and a back portion, and an opening in the front portion for dispensing sheet material therethrough.

5. The system of claim 4, wherein the opening provides a pick/push zone.

6. The system of claim 2, wherein the body includes an opening in the back portion, which provides a relief zone.

7. The system of claim 2, wherein the lower surface of the front portion and the back portion are substantially flat.

8. The system of claim 7, wherein a step is formed on the lower surface between the front portion and the back portion.

9. The system of claim 2, wherein the back portion provides substantial weight to the restrictor relative to the front portion.

10. The system of claim 2, wherein the upper surface includes a plurality of ribs.

11. A system for dispensing a stack of sheets of sheet material, the system comprising:

a dispenser including a housing comprising a container and a lid which cooperate to provide an inner surface formed to include an internal compartment configured to hold sheet material, the housing including an exit port for withdrawal of sheet material therefrom, the dispenser further comprising a sheet mover mounted to at least a portion of the housing and configured to move in more than one direction when activated to move sheet material adjacent to the exit port, such that when the sheet mover is activated, a portion of the sheet mover contacts at least a portion of a sheet material positioned in the housing and moves in one direction across and against the portion of the sheet material to move the portion of the sheet material at least briefly in the one direction, then the sheet mover moves in an other direction and moves the portion of the sheet of material at least briefly in the other direction, and then the sheet mover moves toward the lid as the lid continues to be lifted, wherein the portion of the sheet material moved is positioned to be easily withdrawn through the exit port by a user; and a restrictor including a body positioned to put pressure on a portion of an upper end of a stack of sheet material disposed in a dispenser, the body including a front portion having narrow perimeter and an opening formed therein which provides a pick/push zone and a back portion providing substantial weight relative to the front portion to a top sheet positioned at an upper end of a stack of sheet material thereby restricting its movement and the movement of a next sheet positioned under the top sheet and sheets positioned thereunder, the back portion having an opening which permits movement of the next sheet when a top sheet is dispensed from a dispenser.

12. The system of claims 11, wherein the body includes an upper surface, a lower surface and an outer perimeter, and wherein the outer perimeter is configured to cover an outer perimeter edge of at least a portion of the top sheet.

13. The system of claim 11, wherein the opening in the front portion is configured to permit dispensing of the top sheet therethrough.

14. The system of claim 12, wherein the lower surface of the front portion and the back portion are substantially flat.

15. The system of claim 14, wherein a step is formed on the lower surface between the front portion and the back portion.

16. A system for dispensing sheet material, the system comprising:

a dispenser including a housing comprising a container and a lid which cooperate to provide an inner surface formed to include an internal compartment configured to hold sheet material, the housing including an exit port for withdrawal of sheet material therefrom, the dispenser further including a sheet mover mounted to at least a portion of the housing and configured to move in more than one direction when activated to move sheet material adjacent to the exit port, such that when the sheet mover is activated, a portion of the sheet mover contacts at least a portion of a sheet material positioned in the housing and moves in one direction across and against the portion of the sheet material to move the portion of the sheet material at least briefly in the one direction, then the sheet mover moves in an other direction and moves the portion of the sheet of material at least briefly in the other direction, and then the sheet mover moves toward the lid as the lid continues to be lifted, wherein the portion of the sheet material moved is positioned to be easily withdrawn through the exit port by a user; and a stack of sheet material disposed in the compartment, the stack of sheet material having a top sheet positioned on an upper end of the stack and a next sheet positioned underneath and next to the top sheet; and a restrictor positioned on at least a portion of the top sheet of the stack of sheet material, the restrictor positioned to provide pressure on at least a portion of the top sheet to restrict movement of the sheet material in the housing, wherein when the dispenser is activated to dispense sheet material via movement of the sheet mover, the restrictor acts to permit the top sheet to be dispensed from the dispenser, the restrictor configured to limit movement of the top sheet and the next sheet to permit only the top sheet to be dispensed, and when the top sheet is dispensed, the restrictor acting to hold the next sheet in a position such that the next sheet becomes a new top sheet and the dispensing process is ready to be repeated.

17. The system of claim 16, wherein the restrictor includes an upper surface, a lower surface, an outer perimeter, a front portion and a back portion.

18. The system of claim 17, wherein the restrictor includes an opening in the front portion for dispensing sheet material therethrough.

19. The system of claim 17, wherein the restrictor includes an opening in the back portion.

20. The system of claim 17, wherein the back portion provides substantial weight to the restrictor relative to the front portion.

* * * * *

UNITED STATES PATENT AND TRADEMARK OFFICE

CERTIFICATE OF CORRECTION

PATENT NO. : 7,591,396 B2
APPLICATION NO. : 11/420085
DATED : September 22, 2009
INVENTOR(S) : Tramontina et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 704 days.

Signed and Sealed this

Twenty-first Day of September, 2010

David J. Kappos

David J. Kappos
*Director of the United States Patent and Trademark Office*